US011920860B2

(12) United States Patent
Hong et al.

(10) Patent No.: US 11,920,860 B2
(45) Date of Patent: Mar. 5, 2024

(54) REFRIGERATOR, SERVER, AND METHOD FOR CONTROLLING THE REFRIGERATOR

(71) Applicant: Samsung Electronics Co., Ltd., Suwon-si (KR)

(72) Inventors: Seungwoo Hong, Suwon-si (KR); Daeun Kim, Suwon-si (KR); Youngju Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 510 days.

(21) Appl. No.: 17/172,502

(22) Filed: Feb. 10, 2021

(65) Prior Publication Data

US 2021/0254884 A1 Aug. 19, 2021

(30) Foreign Application Priority Data

Feb. 13, 2020 (KR) ..... 10-2020-0017547

(51) Int. Cl.
*F25D 29/00* (2006.01)

(52) U.S. Cl.
CPC ..... *F25D 29/005* (2013.01); *F25D 2323/021* (2013.01); *F25D 2700/04* (2013.01);
(Continued)

(58) Field of Classification Search
CPC ..... F25D 29/005; F25D 2323/021; F25D 2700/04; F25D 2700/06; F25D 2700/14;
(Continued)

(56) References Cited

U.S. PATENT DOCUMENTS 9,449,208 B2 * 9/2016 Luk ..... G06K 7/10415
9,982,938 B2 5/2018 Tae et al.
(Continued)

FOREIGN PATENT DOCUMENTS

CN 104832037 A * 8/2015
CN 204574691 U 8/2015
(Continued)

OTHER PUBLICATIONS

International Search Report dated Jun. 4, 2021, issued in International Patent Application No. PCT/KR2021/001816.
(Continued)

*Primary Examiner* — Alicia M. Choi
(74) *Attorney, Agent, or Firm* — Jefferson IP Law, LLP

(57) ABSTRACT

A refrigerator for recognizing an object to be stored and automatically opening a door based on the recognized object, and a method therefor are provided. The refrigerator includes a main body, at least two doors provided on a front surface of the main body, two or more storage rooms provided in the main body or the at least two doors and configured to store objects, a cooler configured to cool the two or more storage rooms, a door driver configured to generate power for automatically opening and closing the at least two doors, a camera configured to photograph an image of surroundings around the at least two doors, and at least one processor configured to, in the case in which an object is recognized from the image of the surroundings, transmit a control signal for opening a door to the door driver based on the recognized object.

20 Claims, 27 Drawing Sheets

(52) U.S. Cl.
CPC ..... *F25D 2700/06* (2013.01); *F25D 2700/14* (2013.01); *F25D 2700/16* (2013.01)

(58) Field of Classification Search
CPC .. F25D 2700/16; F25D 23/028; F25D 25/025; F25D 2400/36; F25D 29/00; F25D 11/02; F25D 29/008; E05F 2015/763; E05F 15/73; E05F 15/611; E05F 2015/765; E05F 2015/767; E05F 15/603; E05B 2047/0056; E05Y 2900/31; A47B 88/457; A47B 2210/175; G06N 3/08; G06V 10/10; H04N 7/18
See application file for complete search history.

(56) References Cited

U.S. PATENT DOCUMENTS

| | | | | |
|---|---|---|---|---|
| 2008/0066475 | A1* | 3/2008 | Cho | A23L 3/36 62/130 |
| 2013/0099715 | A1* | 4/2013 | Fuhge | E05F 15/79 318/484 |
| 2014/0327353 | A1* | 11/2014 | Seo | E05D 7/00 49/31 |
| 2017/0213187 | A1* | 7/2017 | Choi | H04N 7/181 |
| 2018/0089973 | A1* | 3/2018 | Kim | H04L 12/2818 |
| 2018/0239319 | A1* | 8/2018 | Abdoo | G05B 19/042 |
| 2020/0013005 | A1* | 1/2020 | Park | F25D 23/028 |
| 2020/0078935 | A1* | 3/2020 | Kimura | B65B 5/105 |
| 2020/0124329 | A1* | 4/2020 | Han | F25B 49/005 |
| 2020/0252705 | A1* | 8/2020 | Kwon | H04R 1/025 |

FOREIGN PATENT DOCUMENTS

| | | | | | |
|---|---|---|---|---|---|
| CN | 104832037 | B | | 7/2017 | |
| CN | 108151408 | A | * | 6/2018 | |
| CN | 215555218 | U | * | 1/2022 | |
| CN | 114087836 | A | * | 2/2022 | |
| JP | 2002-318060 | A | | 10/2002 | |
| JP | 2002318060 | A | * | 10/2002 | |
| JP | 2017-040422 | A | | 2/2017 | |
| JP | 6336816 | B2 | | 6/2018 | |
| JP | 2019-70467 | A | | 5/2019 | |
| KR | 10-2000-0021976 | A | | 4/2000 | |
| KR | 10-2001-0092060 | A | | 10/2001 | |
| KR | 10-2006-0125016 | A | | 12/2006 | |
| KR | 20080050166 | A | * | 6/2008 | |
| KR | 100895133 | B1 | * | 5/2009 | |
| KR | 10-2009-0075271 | A | | 7/2009 | |
| KR | 10-1071032 | B1 | | 10/2011 | |
| KR | 10-1311168 | B1 | | 3/2013 | |
| KR | 10-2014-0121187 | A | | 10/2014 | |
| KR | 10-2018-0015971 | A | | 2/2018 | |
| KR | 10-1984515 | B1 | | 5/2019 | |
| KR | 10-2019-0084860 | A | | 7/2019 | |
| KR | 10-2020-0007590 | A | | 1/2020 | |
| WO | 2014/208585 | A1 | | 12/2014 | |
| WO | WO-2014208585 | A1 | * | 12/2014 | F25D 11/00 |
| WO | 2019/135670 | A2 | | 7/2019 | |
| WO | WO-2019135670 | A2 | * | 7/2019 | F25D 29/00 |

OTHER PUBLICATIONS

Extended European Search Report dated Sep. 15, 2022, issued in European Patent Application No. 21754395.8.

* cited by examiner

COLLISION POSSIBLE LOCATION

COLLISION IMPOSSIBLE LOCATION

REFRIGERATOR, SERVER, AND METHOD FOR CONTROLLING THE REFRIGERATOR

CROSS-REFERENCE TO RELATED APPLICATION(S)

This application is based on and claims priority under 35 U.S.C. § 119 of a Korean patent application number 10-2020-0017547, filed on Feb. 13, 2020, in the Korean Intellectual Property Office, the disclosure of which is incorporated by reference herein in its entirety.

BACKGROUND

1. Field

The disclosure relates to a refrigerator capable of automatically opening and closing a door, a server for managing the refrigerator, and a method for controlling the refrigerator.

2. Description of Related Art

In general, a refrigerator is equipment that supplies cool air to a storage room storing food to keep the food fresh for a long time. The storage room is maintained within a preset range of temperature required to keep food fresh.

The storage room of the refrigerator opens at the front side, and the open front side is closed by a door.

The door is opened by a user. However, when the user's both hands are not free, such as when the user puts food into the storage room or takes food out of the storage room, the user is not easy to open or close the door by himself or herself. In order to cope with such a case, a refrigerator capable of automatically opening and closing its door is being developed.

The above information is presented as background information only to assist with an understanding of the disclosure. No determination has been made, and not assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a refrigerator for recognizing an object to be stored and automatically opening a door based on the recognized object, a method for controlling the refrigerator, and a server for recognizing an object and transmitting a signal for opening a door to the refrigerator based on the recognized object.

Additional aspects will be set forth in part in the description which follows and, in part, will be apparent from the description, or may be learned by practice of the presented embodiments.

In accordance with an aspect of the disclosure, a refrigerator is provided. The refrigerator includes a main body, at least one door provided on a front surface of the main body, a plurality of storage rooms provided in the main body or the at least one door and configured to store an object, a cooler configured to cool the plurality of storage rooms, a door driver configured to generate power for automatically opening or closing the at least one door, a camera configured to photograph an image of surroundings around the at least one door, and at least one processor configured to, in case an object is recognized from the image of surroundings photographed by the camera, transmit a control signal for opening the at least one door to the door driver based on the recognized object.

The at least one processor may further be configured to determine a storage room corresponding to the recognized object from among the plurality of storage rooms, and transmit a control signal for opening a door of the storage room corresponding to the recognized object among the at least one door to the door driver.

The at least one processor may further be configured to determine a door corresponding to the recognized object among the at least one door, and transmit a control signal for opening the door corresponding to the recognized object to the door driver.

The refrigerator may further include a temperature sensor configured to sense temperature of an object located around the at least one door.

The at least one processor may further be configured to determine, based on temperature sensed by the temperature sensor and the object recognized from the image of surroundings, a storage room among the plurality of storage rooms and storage temperature corresponding to the recognized object.

The at least one processor may further be configured to transmit a control signal to the cooler to control temperature of the storage room corresponding to the recognized object to the storage temperature.

The refrigerator may further include a proximity sensor configured to sense a user's approach, wherein the at least one processor may further be configured to activate the camera, in response to an output of the proximity sensor representing the user's approach.

The refrigerator may further include a speaker, wherein the at least one processor may further be configured to control the speaker to output a notification sound upon automatic opening of the at least one door.

The at least one processor may further be configured to determine a user's relative location with respect to a door expected to open among the at least one door, and control the speaker to output the notification sound differently according to the user's relative location.

The at least one processor may further be configured to determine a user's relative location with respect to a door expected to open among the at least one door, and control an opening angle of the door based on the user's relative location.

The refrigerator may further include a microphone, wherein the at least one processor may further be configured to transmit, in response to a name of an object recognized from a user's voice input to the microphone, a control signal for opening the at least one door to the door driver based on the recognized name of the object.

The refrigerator may further include an internal sensor including at least one of a weight sensor, a distance sensor, or an internal camera. The internal sensor may be provided in at least one storage room among the plurality of storage rooms.

The at least one processor may further be configured to determine whether the storage room corresponding to the recognized object is capable of accommodating the recognized object, based on an output of the internal sensor.

The refrigerator may further include at least one of a speaker or a display, wherein the at least one processor may further be configured to control, according to a result of a determination that the storage room corresponding to the recognized object is incapable of accommodating the recognized object, the at least one of the speaker or the display to output a guide message related to the result of the determination.

The refrigerator may further include a display provided in the at least one door, wherein the at least one processor may further be configured to control, in case an object enters at least one of the plurality of storage rooms or is released from at least one of the plurality of storage rooms, the display to display information related to the entrance or release of the object.

The refrigerator may further include a drawer configured to slide to be taken out of or put into at least one storage room of the plurality of storage rooms, and a drawer driver configured to at least one of generate power for automatically putting the drawer into the at least one storage room, or automatically take the drawer out of at least one storage room among the plurality of storage rooms.

The at least one processor may further be configured to transmit, in case the drawer is provided in the storage room corresponding to the recognized object, a control signal for taking the drawer out of the storage room to the drawer driver.

The refrigerator may further include a transceiver configured to communicate with an external device.

The transceiver may transmit the image of surroundings photographed by the camera to a server, and receive, in case the server recognizes the object, information about the object or information about a door corresponding to the object from the server.

The refrigerator may further include a transceiver configured to be communicate with another refrigerator, wherein the at least one processor may transmit, according to a result of a determination that the storage room corresponding to the recognized object is incapable of accommodating the recognized object, information about the recognized object or a signal for opening a door to the other refrigerator.

The transceiver may receive, from an appliance with a camera, an image photographed by the camera or information about an object recognized from the image photographed by the camera.

The at least one processor may further be configured to determine opening time of the at least one door based on a distance between the appliance and the refrigerator.

The storage room corresponding to the recognized object may include a storage room storing an object related to the recognized object or estimated to store the object related to the recognized object.

A server, according to an embodiment of the disclosure, includes a transceiver configured to receive an image of surroundings from a refrigerator, and at least one processor configured to recognize an object from the image of surroundings, determine whether to open a door provided in the refrigerator based on the recognized object, and control, according to a result of a determination that the door needs to open, the transceiver to transmit a signal for opening the door to the refrigerator.

The refrigerator may include a plurality of storage rooms and a plurality of doors, and the at least one processor may further be configured to determine a storage room corresponding to the recognized object from among the plurality of storage rooms, and control the transceiver to transmit a signal for opening a door of the storage room corresponding to the recognized object among the plurality of doors to the refrigerator.

The transceiver may receive information about temperature of the recognized object from the refrigerator, and the at least one processor may further be configured to determine storage temperature corresponding to the recognized object based on the information about the temperature of the recognized object.

The at least one processor may further be configured to determine at least one of a storage room corresponding to the recognized object or storage temperature corresponding to the recognized object based on a deep learning model generated by learning data obtained from a plurality of users.

The at least one processor may further be configured to control, in case the storage room corresponding to the recognized object is incapable of accommodating the recognized object, the transceiver to transmit a signal for opening a door to another refrigerator registered by a user of the refrigerator.

In accordance with another aspect of the disclosure, a method of controlling a refrigerator including a camera, a plurality of storage rooms, and at least one door positioned on a front surface of the plurality of storage rooms is provided. The method includes photographing an image of surroundings around the at least one door with the camera, and opening, in response to a recognition of an object from the image of surroundings, the at least one door based on the recognized object.

The opening of the at least one door may include determining a storage room corresponding to the recognized object among the plurality of storage rooms, and opening a door of the storage room corresponding to the recognized object among the at least one door.

The method may further include sensing temperature of an object located around the at least one door, wherein the opening of the at least one door may include determining, based on the sensed temperature and the object recognized from the image of the surroundings, a storage room, among the plurality of storage rooms, and a storage temperature corresponding to the recognized object.

The method may further include sensing a user's approach, and activating the camera in response to the sensing of the user's approach.

The opening of the at least one door may include determining whether the storage room corresponding to the recognized object is capable of accommodating the recognized object, and opening a door of the storage room corresponding to the recognized object according to a result of a determination that the storage room corresponding to the recognized object is capable of accommodating the recognized object.

The method may further include outputting, according to a result of a determination that a storage room corresponding to the recognized object is incapable of accommodating the recognized object, a guide message related to the result of the determination.

The method may further include triggering voice recognition in the case in which the object is not recognized from the image of surroundings, receiving a user's voice through a microphone provided in the refrigerator, and opening, according to recognition of a name of the object from the user's voice input to the microphone, the at least one door based on the recognized name of the object.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

These and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
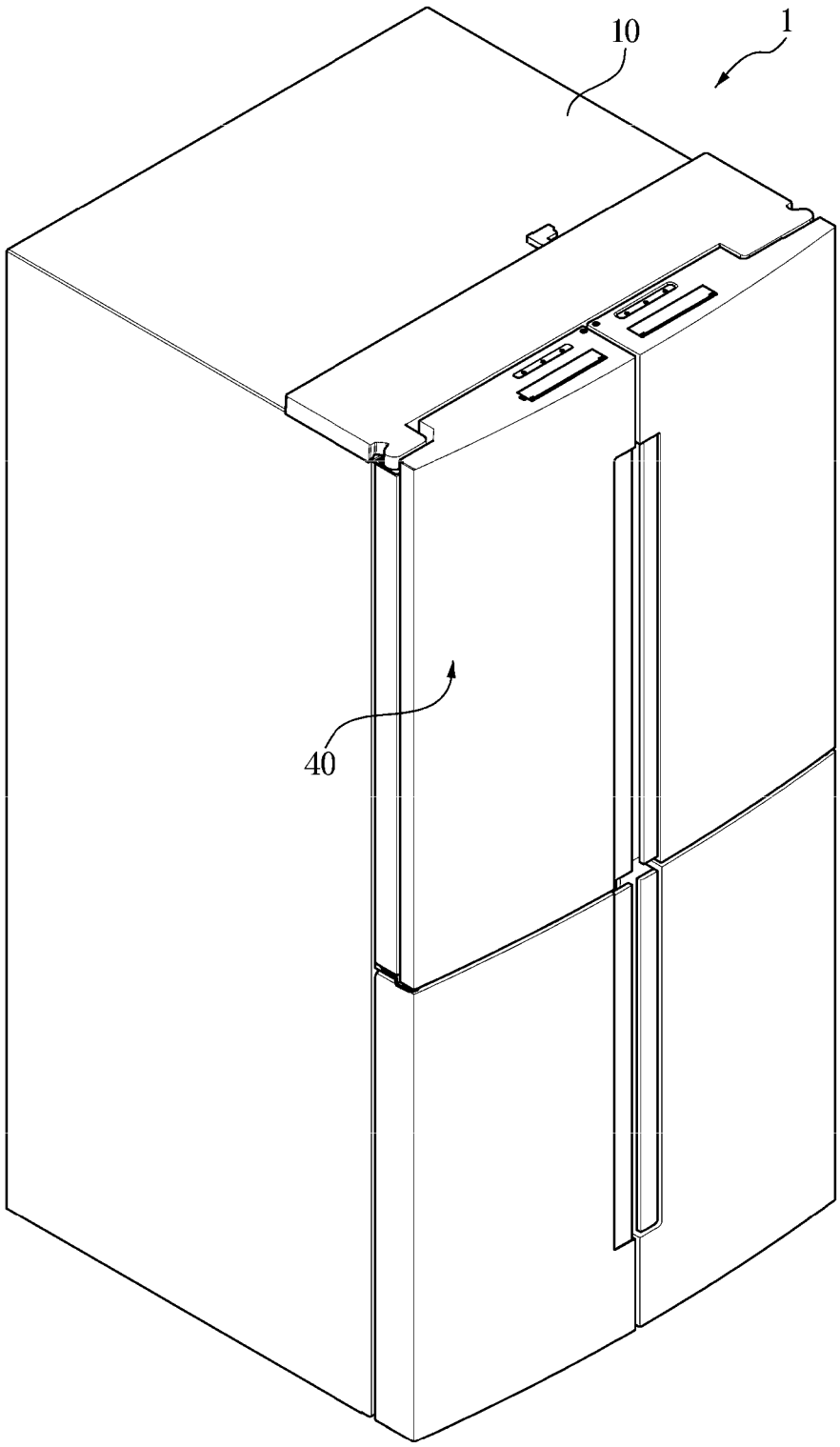
FIG. 1 illustrates an outer appearance of a refrigerator in the state in which a door of the refrigerator is closed according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Like reference numerals will refer to like components throughout this specification. This specification does not describe all components of the embodiments, and general information in the technical field to which the disclosure belongs or overlapping information between the embodiments will not be described. As used herein, the terms "portion", "part, "module, "member" or "block" may be implemented as software or hardware, and according to embodiments, a plurality of "portions", "parts, "modules, "members" or "blocks" may be implemented as a single component, or a single "portion", "part, "module, "member" or "block" may include a plurality of components.

Through this specification, it will be understood that when a certain part is referred to as being "connected" to another part, it can be directly or indirectly connected to the other part. When a part is indirectly connected to another part, it may be connected to the other part through a wireless communication network or may be electrically connected to the other part through electrical wiring.

Also, it will be understood that when a certain part "includes" a certain component, the part does not exclude another component but can further include another component, unless the context clearly dictates otherwise.

In the entire specification, it will also be understood that when an element is referred to as being "on" or "over" another element, it can be directly on the other element or intervening elements may also be present.

In the entire specification, it will also be understood that when a certain component transfers or transmits a signal or data to another component, a case in which another component is present between the corresponding component and the other component and the corresponding component transfers or transmits the signal or data through the other component is not exclusive, unless the context clearly dictates otherwise.

In the entire specification, the ordinal terms "first", "second", etc. are used to distinguish a plurality of components from each other, without representing an arrangement order of the components, a manufacturing order of the components, importance of the components, etc.

It is to be understood that the singular forms "a," "an," and "the" include plural referents unless the context clearly dictates otherwise.

Reference numerals used in operations are provided for convenience of description, without describing the order of the operations, and the operations can be executed in a different order from the stated order unless a specific order is definitely specified in the context.

Throughout the disclosure, the expression "at least one of a, b or c" indicates only a, only b, only c, both a and b, both a and c, both b and c, all of a, b, and c, or variations thereof.

Hereinafter, a refrigerator, a server, and a control method of the refrigerator, according to an aspect, will be described in detail with reference to the accompanying drawings.

The refrigerator according to an aspect may include at least one door. Accordingly, the refrigerator according to an aspect may include one, two, or three doors. In embodiments of the disclosure, which will be described below, a refrigerator including four doors will be described as an example to describe various examples.

The refrigerator according to an aspect may be a side by side type refrigerator in which a freezing room and a refrigerating room are arranged side by side, a bottom freeze type refrigerator in which a refrigerating room is formed in the upper portion and a freezing room is formed in the lower portion, a top mount type refrigerator in which a freezing room is formed in the upper portion and a refrigerating room is formed in the lower portion, or a combined type refrigerator to which characteristics of the above-mentioned types are mixed and applied. However, for a detailed description, in the embodiments of the disclosure which will be described below, a bottom freeze type refrigerator in which a freezing room is formed in the lower portion will be described as an example.

Figure 2:
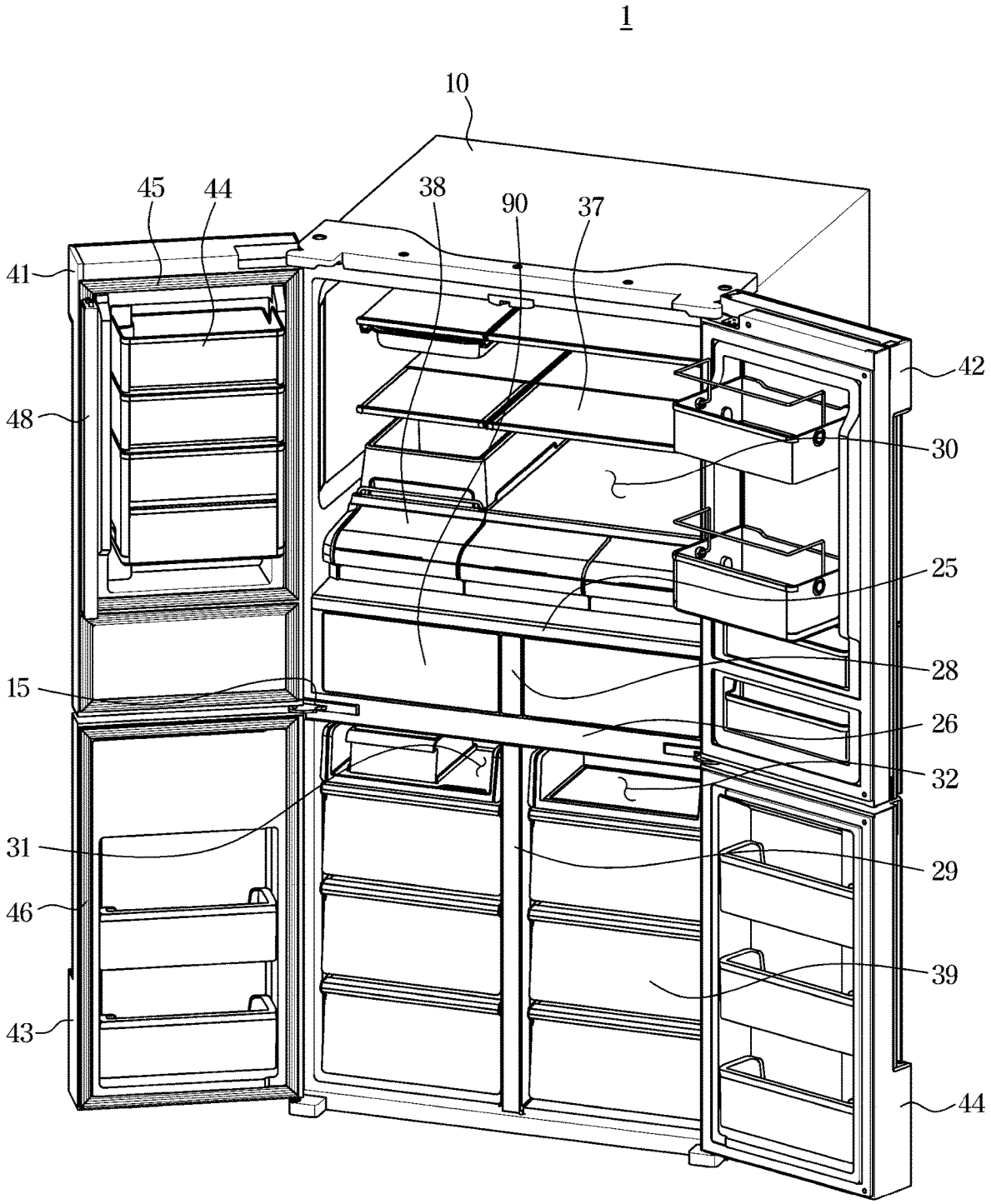
FIG. 2 illustrates an outer appearance of a refrigerator in the state in which a door of the refrigerator is opened according to an embodiment of the disclosure.
Figure 3:
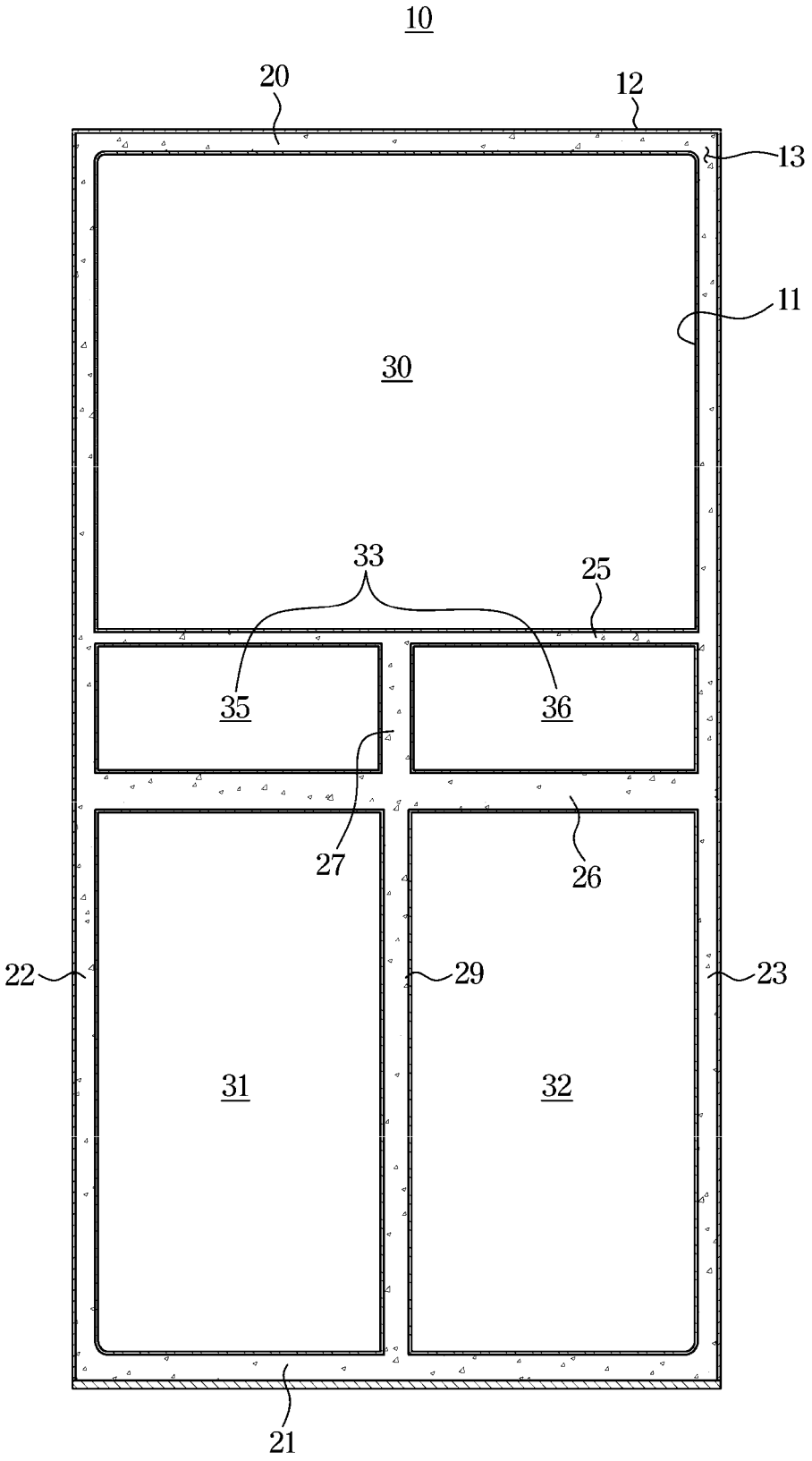
FIG. 3 is a front cross-sectional view schematically illustrating space division of a refrigerator according to an embodiment of the disclosure.

FIG. 1 illustrates an outer appearance of a refrigerator in the state in which a door of the refrigerator is closed according to an embodiment of the disclosure, FIG. 2 illustrates an outer appearance of a refrigerator in the state in which a door of the refrigerator is opened according to an embodiment of the disclosure, and FIG. 3 is a front cross-sectional view schematically illustrating space division of a refrigerator according to an embodiment of the disclosure.

Referring to FIGS. 1-3, a refrigerator 1 may include a main body 10, a plurality of storage rooms 30, 31, 32, and 33 formed in inside of the main body 10 to store food, and a door 40 for opening or closing the plurality of storage rooms 30, 31, 32, and 33.

In the current example, a case in which the door 40 includes four doors 41, 42, 43, and 44 will be described as an example.

The plurality of storage rooms 30, 31, 32, and 33 may include an upper storage room 30, lower storage rooms 31 and 32, and a center storage room 33 formed between the upper storage room 30 and the lower storage rooms 31 and 32.

The upper storage room 30 may be a refrigerating room 30 for keeping food refrigerated. The refrigerating room 30 may be maintained at temperature of about ° C. to about 5° C. to keep food refrigerated.

The lower storage rooms 31 and 32 may include a first freezing room 31 for keeping food frozen, and a first temperature conversion room 32 of which temperature is adjusted. The first freezing room 31 may be maintained at temperature of about 0° C. to about −30° C. to keep food frozen.

Temperature of the first temperature conversion room 32 may be adjusted between refrigerating temperature and freezing temperature. For example, the temperature of the first temperature conversion room 32 may be adjusted within a temperature zone among four temperature zones of a freezing temperature zone of −23° C. to −17° C., a thin ice temperature zone of −5° C., a soft freezing temperature zone of −1° C., and a refrigerating temperature zone of 2° C.

The refrigerator 1 may include an inputter (not shown) for receiving an input of a temperature zone selected by a user from among a plurality of temperature zones. In response to an input of a temperature zone selected by a user, the temperature of the first temperature conversion room 32 may be adjusted to the selected temperature zone.

However, the embodiment of the refrigerator 1 may not necessarily include the first temperature conversion room 32, and a freezing room, instead of the first temperature conversion room 32, may be provided by a change of design so that all the lower storage rooms 31 and 32 may be implemented as freezing rooms.

The center storage room 33 may include a second freezing room 35 and a second temperature conversion room 36 that are positioned side by side.

The second freezing room 35 may be maintained at temperature of 0° C. to −30° C., like the first freezing room 31, to keep food frozen.

The second freezing room 35 may have a relatively small size compared to the first freezing room 31 to function as a supplementary freezing room. The first freezing room 31 may be opened or closed by a first lower door 43, and the second freezing room 35 may be opened or closed by a first upper door 41. For example, by keeping food having relatively low frequency of use and a large size in the first freezing room 31 and food having relatively high frequency of use and a small size in the second freezing room 35, it may be possible to raise the efficiency of management and storage, while minimizing unnecessary outflow of cool air.

Temperature of the second temperature conversion room 36 may also be adjusted between the refrigerating temperature and the freezing temperature, like the first temperature conversion room 32.

However, the embodiment of the refrigerator 1 may not necessarily include the second temperature conversion room 36, and a freezing room, instead of the second temperature conversion room 36, may be provided by a change of design so that the entire center storage room 33 may be implemented as a freezing room.

The main body 10 may be substantially in a shape of a box, and a front side of the main body 10 may open. The main body 10 may include an inner case 11, an outer case 12 coupled with an outer side of the inner case 11, and an insulation 13 provided between the inner case 11 and the outer case 12.

The inner case 11 may be injection-molded with a resin material. The inner case 11 may form the refrigerating room 30, the first freezing room 31, the first temperature conversion room 32, the second freezing room 35, and the second temperature conversion room 36 therein. That is, the inner case 11 may limit a space of each storage room.

The outer case 12 may be formed of a metal material. The insulation 13 provided between the inner case 11 and the outer case 12 may be a urethane foam insulation, and may be used together with a vacuum insulation panel as necessary.

The main body 10 may include a top wall 20, a bottom wall 21, a left wall 22, a right wall 23, a rear wall 24, a first partition wall 25, a second partition wall 26, a first middle wall 27, and a second middle wall 29.

The first partition wall 25 may partition an inside space of the main body horizontally. That is, the first partition wall 25 may partition the center storage room 33 from the refrigerating room 30. The first partition wall 25 may extend substantially horizontally from the left wall 22 to the right wall 23, and include the inner case 11 and the insulation 13.

The second partition wall 26 may partition the inside space of the main body 10 horizontally. That is, the second partition wall 26 may partition the center storage room 33. The second partition wall 26 may extend substantially horizontally from the left wall 22 to the right wall 23, and include the inner case 11 and the insulation 13.

The first middle wall 27 may partition the center storage room 33 side by side. That is, the first middle wall 27 may partition the second temperature conversion room 36 from the second freezing room 35. The first middle wall 27 may extend substantially vertically from the first partition wall 25 to the second partition wall 26, and include the inner case 11 and the insulation 13.

The second middle wall 29 may partition the lower storage rooms 31 and 32 side by side. That is, the second middle wall 29 may partition the first temperature conversion room 32 from the first freezing room 31. The second middle wall 29 may extend substantially vertically from the second partition wall 26 to the bottom wall 21, and include the inner case 11 and the insulation 13.

Each storage room may include a shelf 37 on which food is put, an airtight container 38 in which food is sealed and stored, and a drawer 39 that slides back and forth to be inserted into or taken out of the refrigerator 1.

In the second freezing room 32, a mini freezing box 90 having a storage space for storing food may be provided. The mini freezing box 90 may be provided to easily store food and put/take food in/out of the second freezing room 32 having a relatively narrow space. The mini freezing box 90 may include a middle wall 28.

The door 40 for opening or closing the plurality of storage rooms 30, 31, 32, and 33 may include four doors of the first upper door 41, a second upper door 42, the first lower door 43, and a second lower door 44. The doors 41, 42, 43, and 44 may be rotatably coupled with the main body 10.

The first upper door 41 and the second upper door 42 may be rotatably coupled with the main body 10 by an upper hinge and a middle hinge 15. The middle hinge 15 may be coupled with the second partition wall 26 to support the first upper door 41 and the second upper door 42. The first upper door 41 and the second upper door 42 may rotate in opposite directions to be opened or closed.

The first upper door 41 and the second upper door 42 may open or close the refrigerating room 30 and the center storage room 33 together. More particularly, the first upper door 41 may open or close a portion of the refrigerating room 30 and the second freezing room 35, and the second upper door 42 may open or close the remaining portion of the refrigerating room 30 and the second temperature conversion room 36.

The portion of the refrigerating room 30, which is opened or closed by the first upper door 41, may be an area that faces the first upper door 41 closed, and the remaining portion of the refrigerating room 30, which is opened or closed by the second upper door 42, may be an area that faces the second upper door 42 closed.

Accordingly, by opening the first upper door 41, the refrigerating room and the second freezing room 35 may open at the same time, and, by opening the second upper door 42, the refrigerating room 30 and the second temperature conversion room 35 may open at the same time.

On the first upper door 41, a filler 48 may be provided to prevent outflow of cool air between the first upper door 41 and the second upper door 42 in the state in which the first upper door 41 and the second upper door 42 are closed.

On rear surfaces of the first and second upper doors 41 and 42, upper sealing members 45 may be provided to prevent outflow of cool air between the first and second upper doors 41 and 42 and the main body 10 in the state in which the first and second upper doors 41 and 42 are closed. On rear surfaces of the first and second lower doors 43 and 44, lower sealing members 46 may be provided to prevent outflow of cool air between the first and second lower doors 43 and 44 and the main body 10 in the state in which the first and second lower doors 43 and 44 are closed. The upper and lower sealing members 45 and 46 may be formed of a rubber material.

The first lower door 43 and the second lower door 44 may be rotatably coupled with the main body 10 by the middle hinge 15 and a lower hinge. The first lower door 43 and the second lower door 44 may rotate in opposite directions to be opened or closed.

The first lower door 43 may open or close the first freezing room 31. The second lower door 44 may open or close the first temperature conversion room 32.

Meanwhile, a storage room for storing food may be provided in the door as well as the main body 10. For example, various shapes of door shelves 44 on which food is put may be mounted on a rear side of the door 40. For example, the door shelves 44 may keep liquid food, such as drinks, alcohol, bottled water, and milk, and fragile food having a certain shape, such as eggs, separately.

The above-described structure and configuration of the refrigerator 1 may be an example that is applicable to the refrigerator 1 according to an embodiment of the disclosure, and the refrigerator 1 according to an embodiment of the disclosure may have another structure and configuration than the above-described structure and configuration. However, for a detailed description, embodiments which will be described below are based on the refrigerator 1 having the structure and configuration shown in FIGS. 1 to 3.

Figure 4:
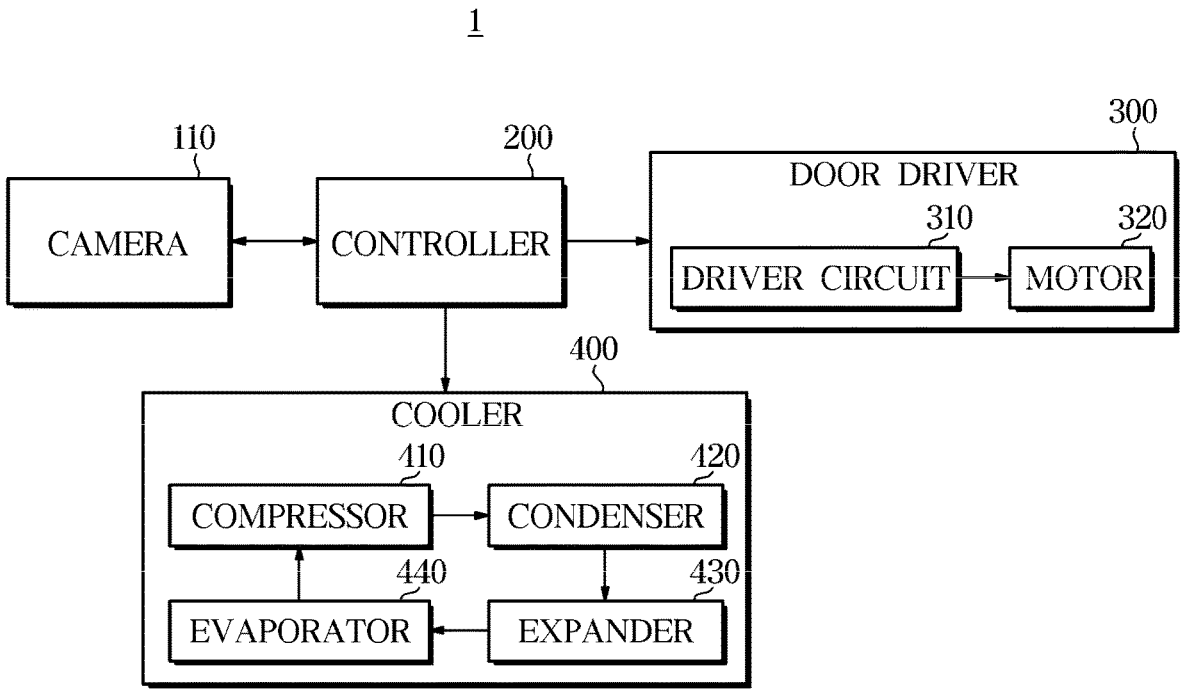
FIG. 4 is a control block diagram of a refrigerator according to an embodiment of the disclosure.

FIG. 4 is a control block diagram of a refrigerator according to an embodiment of the disclosure.

Referring to FIG. 4, the refrigerator 1 according to an embodiment of the disclosure may include a door driver 300 for generating power for automatically opening or closing at least one of the plurality of doors 41, 42, 43, and 44, a camera 110 for photographing images of surroundings, a controller 200 (e.g., at least one processor) for transmitting, to the door driver 300, a control signal for opening at least one door of the doors 41, 42, 43, and 44 based on an object recognized from an image of surroundings photographed by the camera 110, and a cooler 400 for supplying cool air to the plurality of storage rooms 30, 31, 32, and 33.

In the current embodiment, descriptions are given based on the refrigerator 1 including four doors 41, 42, 43, and 44, however, embodiments of the disclosure may also be applied to refrigerators having one, two, or three doors, as described above. Also, the embodiments of the disclosure may be applied to refrigerators having five doors or more. That is, the number of doors is not limited.

Generally, a user himself or herself opens or closes a door of a refrigerator to put food into the refrigerator or take food out of the refrigerator. However, the refrigerator 1 according to an embodiment of the disclosure may be opened or closed automatically, as well as manually by a user. Accordingly, by automatically opening or closing a door in the case in which a user's both hands are not free due to the reason why the user holds food to be stored in the refrigerator 1 or an object related to food to be taken out of the refrigerator 1 in his/her hands, etc., the user's convenience may be improved.

The door driver 300 for generating power for automatically opening or closing the door 40 may include a motor 320 and a driver circuit 310 for driving the motor 320. The driver circuit 310 may rotate the motor 320 forward or backward according to a control signal transmitted from the controller 200, and the door 40 may be opened or closed through the forward or backward rotation of the motor 320.

In the case in which a plurality of doors 40 are provided, a plurality of door drivers 300 may be provided to correspond to the number of the doors 40 to supply power to the individual doors 40, or a single door driver 300 may supply power to the plurality of doors 40 by using a switching device capable of switching power transfer.

Power generated by the door driver 300 may be transferred to the door 40 by a power transfer device including a plurality of gears. Also, the power transfer device may be switched between a power transfer state for transferring power of the motor 320 to the door 40 and a power non-transfer state for transferring no power to the door 40 to enable switching between automatic opening/closing and manual opening/closing of the door 40.

In the embodiment of the refrigerator 1, a method of automatically opening or closing the door 40 is not limited, and accordingly, any one of various techniques for automatically opening or closing a refrigerator may be applied.

Meanwhile, objects that are stored in the refrigerator 1 according to an embodiment of the disclosure are not limited to food. Targets that are stored in the refrigerator 1, such as containers for keeping food, objects required to be kept refrigerated or frozen for certain purposes, and objects to be kept refrigerated or frozen according to a user's intention regardless of certain purposes, are not limited. Accordingly, in the following embodiments of the disclosure, food and nonfood are collectively referred to as objects.

The camera 110 may be positioned at a location capable of photographing images of surroundings around the door 40. For example, the camera 110 may be positioned on at least one of the plurality of doors 41, 42, 43, and 44 or on a top of the main body 10.

The camera 110 may be installed toward a front direction of the refrigerator 1. The camera 110 may be positioned at a location capable of photographing a subject located in front of the refrigerator 1, and a view angle or tilt angle of the camera 110 is not limited. Accordingly, images of surroundings, photographed by the camera 110, may include images of surroundings located beside the refrigerator 1, as well as images of surroundings located in front of the refrigerator 1. Also, the tilt angle of the camera 110 may be inclined downward.

Meanwhile, a camera equipped in a mobile device, such as a mobile phone or a tablet personal computer (PC), may perform functions of the camera 110. For example, a holder for holding a mobile device may be provided on the refrigerator 1, and a mobile device equipped with a camera may be hold on the refrigerator 1 to photograph an image of surroundings. An image of surroundings, photographed by the mobile device, may be transmitted to the refrigerator 1 or a server 800 (see FIG. 22) that manages the refrigerator 1. To transmit images to the refrigerator 1 or the server 800, a refrigerator management application may be installed in the mobile device.

An image of surroundings, photographed by the camera 110, may include an object carried by a user located around one of the plurality of doors 41, 42, 43, and 44.

The controller 200 may itself recognize an object from an image of surroundings, photographed by the camera 110, or transmit the image of surroundings to the server 800 (see FIG. 22) and receive a result of object recognition from the server 800. First, a case in which the controller 200 itself recognizes an object will be described as an example.

The controller 200 may apply an object recognition algorithm to an image of surroundings, photographed by the camera 110, to recognize an object. The controller 200 may set objects that are capable of being kept in the refrigerator 1 in advance and recognize a preset object among the preset objects from an image of surroundings, or the controller 200 may recognize an object from an image of surroundings regardless of a kind of the object and then determine whether or not the recognized object is a preset object.

In all cases, according to recognition of a preset object from an image of surroundings photographed by the camera 110, the controller 200 may transmit a control signal for opening at least one of the plurality of doors 41, 42, 43, and 44 to the door driver 300.

Objects capable of being kept in the refrigerator 1 may be set in a manufacturing process of the refrigerator 1 or set by a user who has purchased the refrigerator 1. Also, after objects capable of being kept in the refrigerator 1 are set in a manufacturing process of the refrigerator 1, new objects may be added by a user or some of the objects may be deleted or replaced by the user. Also, in the case in which the server 800 manages a plurality of refrigerators, objects capable of being kept in the refrigerator 1 may be added based on information about objects kept in other users' refrigerators, which will be described later.

The refrigerator 1 may include the plurality of storage rooms 30, 31, 32, and 33 for storing food, as described above. The controller 200 may determine a storage room corresponding to a recognized object from among the plurality of storage rooms 31, 32, and 33, and transmit a control signal for opening a door of the storage room corresponding to the recognized object to the door driver 300.

The storage room corresponding to the recognized object may be a storage room that is suitable to store the recognized object. For example, according to a result of recognition as an object required to be kept refrigerated, the controller 200 may determine that the storage room corresponding to the recognized object is the refrigerating room 30, and according to a result of recognition as an object required to be kept frozen, the controller 200 may determine that the storage room corresponding to the recognized object is the freezing rooms 31 and 35. Also, according to a result of recognition as an object required to be kept at certain temperature, neither required to be kept refrigerated nor required to be kept frozen, the controller 200 may determine that the storage room corresponding to the recognized object is the temperature conversion rooms 32 and 36.

Information about storage rooms corresponding to recognized objects may have been stored in advance in the controller 200. More particularly, information about storage rooms corresponding to individual objects may be stored to match with the objects, or storage temperature that is suitable for individual objects may be stored to match with the objects and temperature of the individual storage rooms may be stored to match with the storage rooms.

Also, information about storage rooms corresponding to recognized objects may be obtained from the server 800.

Also, in the case in which an object includes an identification mark, such as a barcode or a Quick Response (QR) code, including information about the object, the controller 200 may recognize such a graphical object from an image of surroundings and obtain information about the object from the recognized identification mark. Information about an object may include information about a kind of the object, that is, what the object is, and information about a storage environment (storage temperature, expiration date, etc.) of the object.

A door of the storage room corresponding to the recognized object may be a door capable of opening and closing the corresponding storage room. Referring again to the example of FIG. 2, the first upper door 41 may open or close a portion of the refrigerating room 30 and the second freezing room 35, and the second upper door 42 may open or close the remaining portion of the refrigerating room 30 and the second temperature conversion room 36. Therefore, according to a result of a determination that the storage room corresponding to the recognized object is the second freezing room 35, a control signal for opening the first upper door 41 may be transmitted to the door driver 300, and according to a result of a determination that the storage room corresponding to the recognized object is the second temperature conversion room 36, a control signal for opening the second upper door 42 may be transmitted to the door driver 300. Also, according to a result of a determination that the storage room corresponding to the recognized object is the refrigerating room 31, a control signal for opening at least one of the first upper door 41 or the second upper door 42 may be transmitted to the door driver 300.

Meanwhile, the controller 200 may determine a door corresponding to a recognized object, and transmit a control signal for opening the door corresponding to the recognized object to the door driver 300. The door corresponding to the recognized object may be a door capable of opening a storage room that is suitable to keep the recognized object. For this, the controller 200 or the server 800 may match individual objects with doors corresponding to the respective objects and store results of the matching.

The controller 200 may include at least one memory storing a program for performing the above-described operations and operations which will be described later and various data required to execute the program, and at least one processor for executing the stored program.

In the case in which a plurality of memories and a plurality of processors are provided, the memories and processors may be integrated into one chip or some of the memories and processors may be physically separated.

The cooler 400 may supply cool air to the storage rooms 30, 31, 32, and 33 by using evaporation of refrigerant to thereby maintain temperature of the storage rooms 30, 31, 32, and 33 within a preset temperature range.

The cooler 400 may include a compressor 410 for compressing gas refrigerant, a condenser 420 for converting the compressed gas refrigerant into liquid refrigerant, an expander 430 for decompressing the liquid refrigerant, and an evaporator 440 for converting the decompressed liquid refrigerant into a gas state.

The compressor 410 may compress inhaled gas refrigerant at low temperature and low pressure and discharge gas at high temperature and high pressure. For this, the compressor 410 may inhale refrigerant forcedly and compress the inhaled refrigerant to change to gas at high temperature and high pressure, wherein the refrigerant may be inhaled by a rotation force of a motor installed.

The refrigerant may circulate within a cooling cycle of the refrigerator 1 by a force by which the compressor 410 inhales the refrigerant. Accordingly, a circulation amount or circulation speed of the refrigerant may depend on a driving level of the compressor 410, and further, the cooling efficiency of the refrigerator 1 may also depend on the driving level of the compressor 410.

The refrigerant at high temperature and high pressure, compressed by the compressor 410, may be transferred to the condenser 420.

The condenser 420 may be connected to a high pressure-side exhaust pipe of the compressor 410 to heat-exchange the refrigerant at high temperature and high pressure, compressed by the compressor 410, with surrounding air to condense the refrigerant to a liquid state. In the condenser 420, the refrigerant may be condensed into liquid to emit heat to outside, and accordingly, temperature of the refrigerant may be lowered.

The expander 430 may decompress the liquid-state refrigerant at room temperature and high pressure, condensed by the condenser 420, by expanding the refrigerant to two-phase refrigerant which is at low temperature and low pressure and in which a liquid component and a gas component are mixed. The expander 430 may be an expansion valve.

Also, as the expander 430, a capillary tube, instead of the expansion valve, may be used. The capillary tube may be implemented as a thin tube, and refrigerant passed through the capillary tube may be decompressed and transferred to the evaporator 440.

The evaporator 440 may evaporate the liquid-state refrigerant at low temperature and low pressure, expanded by the expander 430, to a gas state, to supply cool air.

In this way, the cooler 400 may supply cool air to the storage rooms 30, 31, 32, and 33 by using a phenomenon in which decompressed liquid refrigerant absorbs thermal energy of surrounding air while changing to a liquid state.

Meanwhile, temperature of a part of the plurality of storage rooms 30, 31, 32, and 33 may be independently controlled. For this, a plurality of coolers 400 may be provided. The plurality of coolers 40 may be independently configured or share some components.

For example, three coolers 400 may be provided. One of the three coolers 400 may supply cool air to the refrigerating room 30, another one may supply cool air to the first freezing room 31 and the second freezing room 35, and the remaining one may supply cool air to the first temperature conversion room 32 and the second temperature conversion room 36.

The controller 200 may transmit a control signal to the cooler 400 for supplying cool air to the refrigerating room 30 to control temperature of the refrigerating room 30, transmit a control signal to the cooler 400 for supplying cool air to the first freezing room 31 and the second freezing room 35 to control temperature of the first freezing room 31 and the second freezing room 32, and transmit a control signal to the cooler 400 for supplying cool air to the first temperature conversion room 32 and the second temperature conversion room 36 to control temperature of the first temperature conversion room 32 and the second temperature conversion room 36.

For example, according to a result of a determination that a recognized object is an object required to be kept at certain temperature, the controller 200 may determine a storage room corresponding to the recognized object and storage temperature corresponding to the recognized object, and control temperature of the storage room corresponding to the recognized object to the storage temperature corresponding to the recognized object.

The temperature of the storage room may be controlled after the object is stored in the storage room. For example, after opening and closing of a door of the storage room corresponding to the recognized object, it may be assumed that the recognized object has been stored in the corresponding storage room, and the temperature of the storage room may be controlled. Also, it may be determined whether an object has been stored in a storage room, based on an output of an internal sensor 150 (see FIG. 13) provided in the storage room, which will be described later.

Hereinafter, various embodiments in which the refrigerator 1 recognizes an object and automatically opens or closes a door will be described in detail.

Figure 5:
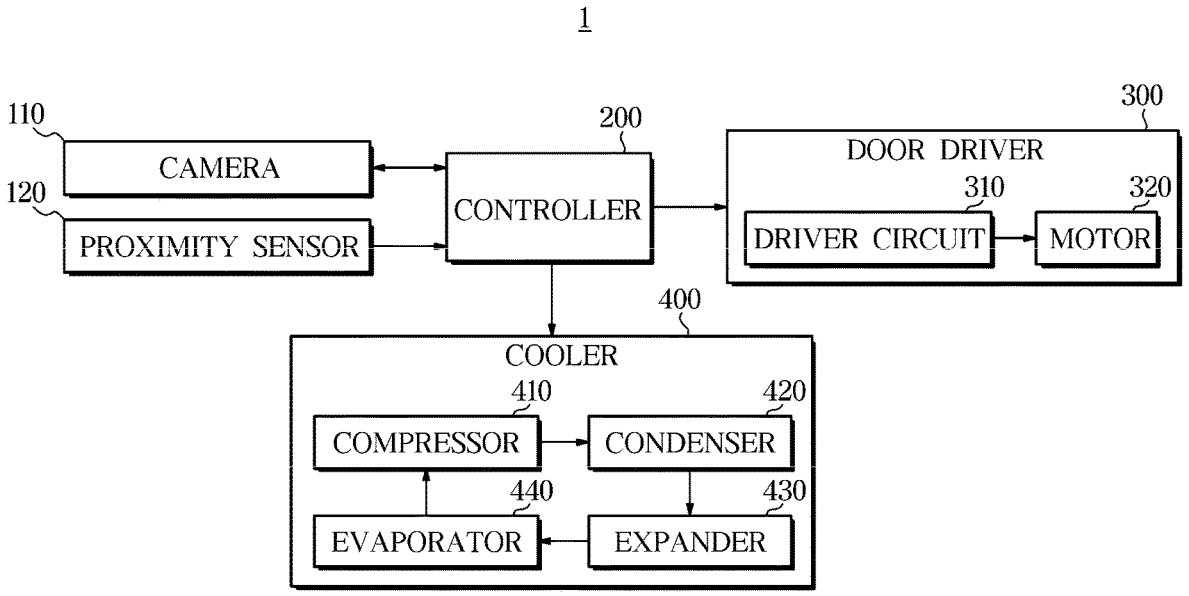
FIG. 5 is a control block diagram of a refrigerator further including a proximity sensor for sensing a user's approach according to an embodiment of the disclosure.
Figure 6:
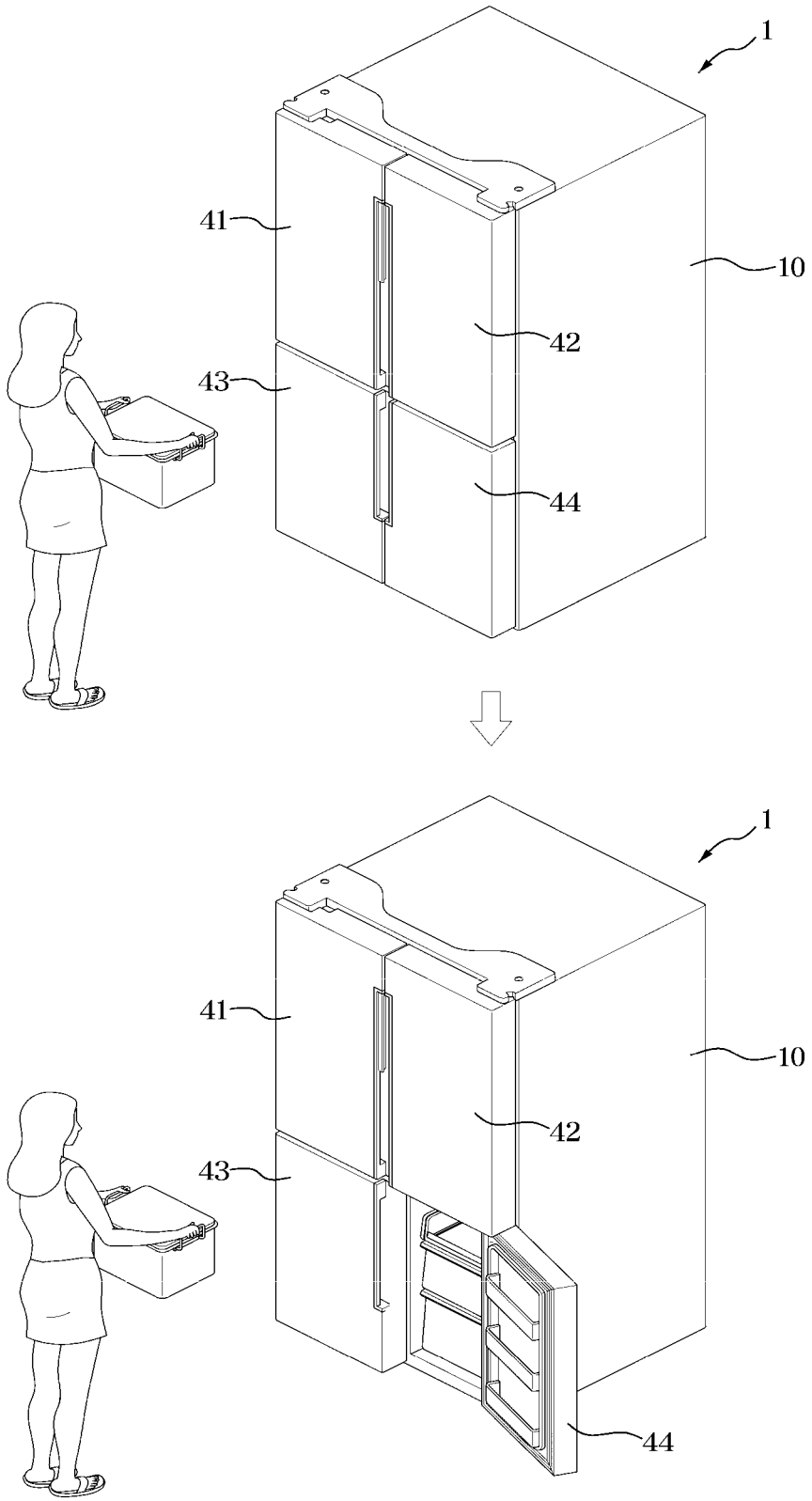
FIGS. 6 and 7 illustrate examples in which a refrigerator opens doors corresponding to recognized objects according to an embodiment of the disclosure.
Figure 7:
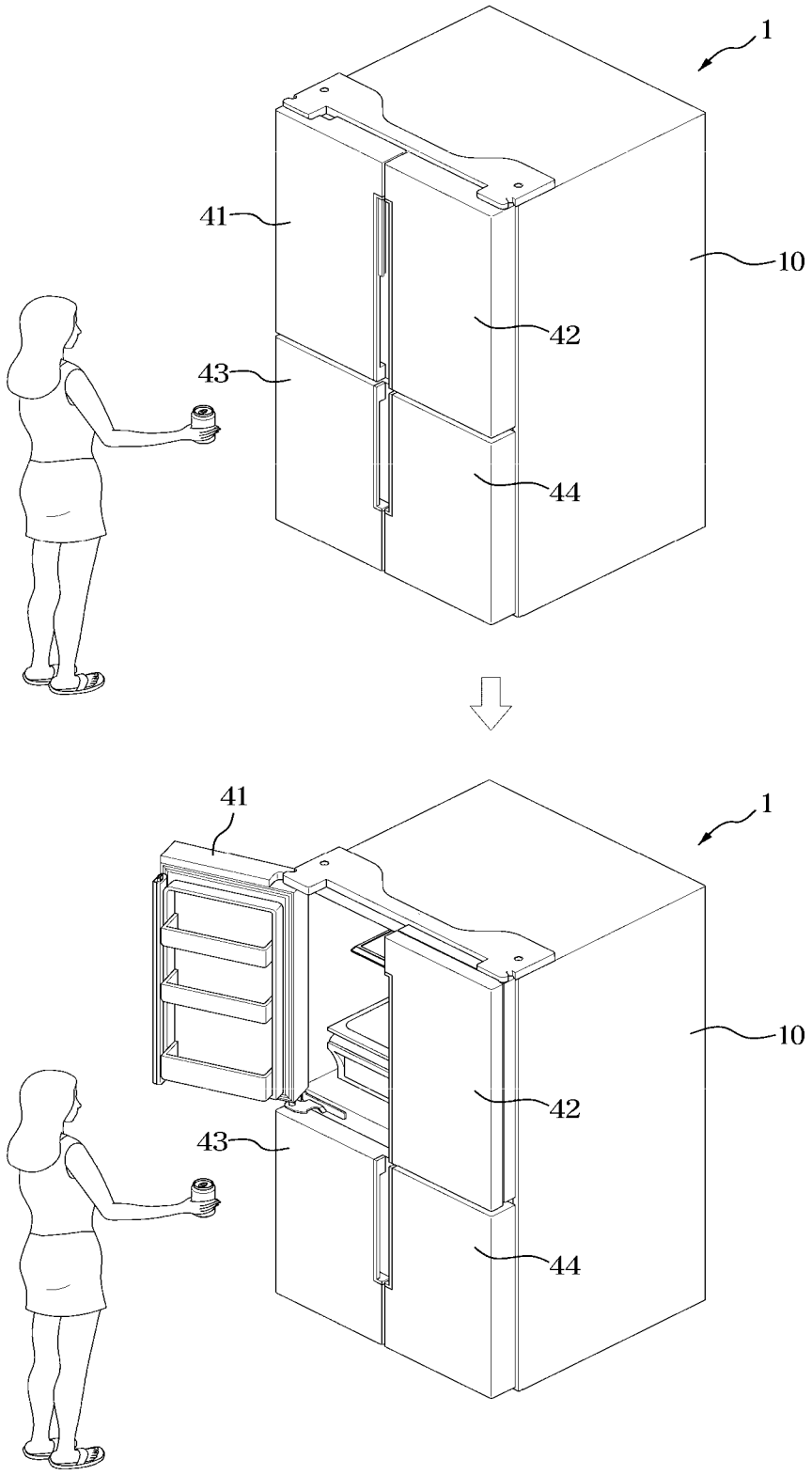

FIG. 5 is a control block diagram of a refrigerator further including a proximity sensor for sensing a user's approach according to an embodiment of the disclosure, and FIGS. 6 and 7 illustrate examples in which a refrigerator according to an embodiment of the disclosure opens doors corresponding to recognized objects.

Referring to FIG. 5, the refrigerator 1 according to an embodiment of the disclosure may activate the camera 110 in response to a user's approach to the refrigerator 1 to protect the user's privacy and reduce consumption power.

For this, referring to FIG. 5, the refrigerator 1 according to an embodiment of the disclosure may further include a proximity sensor 120 for sensing a user's approach. The proximity sensor 120 may be one among various types of sensors, such as an ultrasonic sensor, an infrared sensor, an optical sensor, and a magnetic sensor, which changes its output upon an approach of an object.

The controller 200 may activate the camera 110 based on an output of the proximity sensor 120. More particularly, in response to an output of the proximity sensor 120 representing a user's approach, the controller 110 may activate the camera 110.

An output of the proximity sensor 120 may itself be a value representing a user's approach or non-approach according to a specification of the proximity sensor 120, or the controller 200 may determine a user's approach based on an output of the proximity sensor 120. In the latter case, the controller 200 may store a reference value representing a user's approach according to a type of the proximity sensor 120, and activate the camera 110 in response to an output of the proximity sensor 120 being greater than or equal to the reference value or being smaller than or equal to the reference value.

Activation and deactivation of the camera 110 may be implemented softwarily or hardwarily. In the case in which activation and deactivation of the camera 110 are implemented softwarily, the camera 110 may be activated by starting photographing. In the case in which activation and deactivation of the camera 110 are implemented hardwarily, a shutter structure may be positioned at the front of the camera 110, the shutter structure may move to deviate from a field of view (FOV) of the camera 110 in response to activation of the camera 110, and, in response to deactivation of the camera 110, the shutter structure may again move to the front of the camera 110 to be within the FOV of the camera 110.

According to activation of the camera 110, the camera 110 may photograph an image of surroundings, and the controller 200 may recognize an object from the image of surroundings.

Referring to FIG. 6, in the case in which a user carries a kimchi container, an image of surroundings photographed by the camera 110 may include the kimchi container carried by the user, and the controller 200 may apply an object recognition algorithm to the image of surroundings to recognize the kimchi container.

In the memory of the controller 200, information about a storage room corresponding to the kimchi container or a door corresponding to the kimchi container may be stored. For example, the first temperature conversion room 32 of which temperature is controllable to certain temperature may be stored as a storage room corresponding to a kimchi container, and the controller 200 may transmit a control signal to the door driver 300 to open the first temperature conversion room 32 to thereby open the second lower door 44.

As such, in the case in which a storage room corresponding to the recognized object is a temperature conversion room of which temperature is independently controllable, the controller 200 may control temperature of the temperature conversion room to storage temperature corresponding to the recognized object. For this, in the memory of the controller 200, information about storage temperature corresponding to individual objects, that is, storage temperature at which the corresponding objects are appropriately stored may be stored, and the processor of the controller 200 may determine storage temperature corresponding to the recognized object based on the stored information.

Referring to FIG. FIG. 6, the controller 200 may determine storage temperature corresponding to the kimchi container, and transmit a control signal to the cooler 400 for supplying cool air to the first temperature conversion room 32, to control the temperature of the first temperature conversion room 32 to the storage temperature corresponding to the kimchi container.

Also, referring to FIG. 7, in the case in which a user carries canned beer, an image of surroundings photographed by the camera 110 may include the canned beer carried by the user, and the controller 200 may apply the object recognition algorithm to the image of surroundings to recognize the canned beer.

In the memory of the controller 200, information about a storage room corresponding to canned beer or a door corresponding to canned beer may be stored. For example, the refrigerating room 30 may be stored as a storage room corresponding to canned beer, and the controller 200 may transmit a control signal to the door driver 300 to open the refrigerating room 30, thereby opening the first upper door 41.

Meanwhile, doors corresponding to the refrigerating room 30 may be the first upper door 41 and the second upper door 42. The controller 200 may select and open an arbitrary one or both of the first upper door 41 and the second upper door 42. The controller 200 may determine a location capable of receiving the canned beer based on an output of the internal sensor 150 (see FIG. 13) which will be described later, and open a door corresponding to the determined location.

Figure 8:
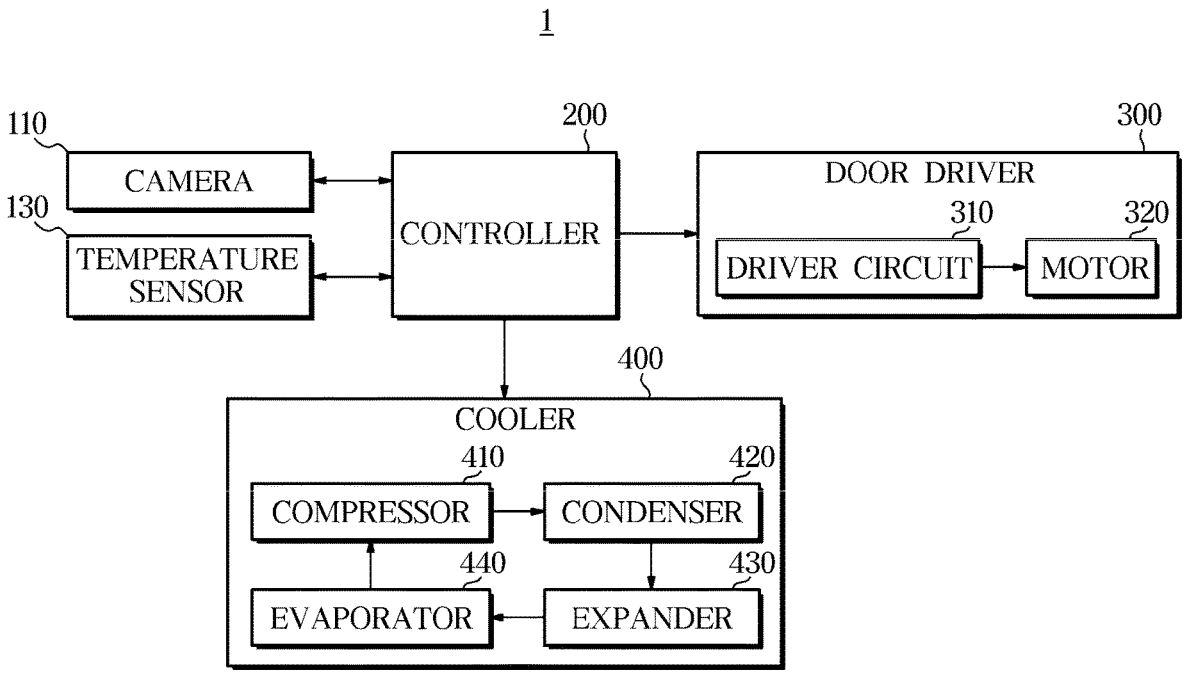
FIG. 8 is a control block diagram of a refrigerator further including a temperature sensor according to an embodiment of the disclosure.

FIG. 8 is a control block diagram of a refrigerator further including a temperature sensor according to an embodiment of the disclosure.

Referring to FIG. 8, the refrigerator 1 according to an embodiment of the disclosure may further include a temperature sensor 130 for sensing temperature of an object located around at least one door 40. The temperature sensor 130 may be a temperature sensor that senses, instead of sensing inside temperature of the refrigerator 1, outside temperature of the refrigerator 1, specifically, temperature of an object located around the door 40. The temperature sensor 130 may be a contactless temperature sensor.

The controller 200 may determine, based on temperature sensed by the temperature sensor 130 and an object recognized from an image of surroundings photographed by the camera 110, at least one of a storage room or storage temperature corresponding to the recognized object.

For example, the temperature sensor 130 may be a thermal imaging camera. The controller 200 may determine, based on an image of surroundings photographed by the thermal imaging camera, temperature of an object recognized from the image, and determine at least one of a storage room or storage temperature based on the determined temperature of the object. The controller 200 may select a storage room or change storage temperature of the same storage room, according to the temperature of the object.

According to a detailed example, in the case in which a recognized object is a kimchi container, a storage room corresponding to the recognized object may be the first temperature conversion room 32, as described above. However, storage temperature may be controlled differently according to temperature of the kimchi container, measured by the temperature sensor 130. The controller 200 may control storage temperature to low temperature according to temperature of the kimchi container, which is higher than or equal to a reference value, and control storage temperature to high temperature according to temperature of the kimchi container, which is lower than or equal to another reference value. With elapse of preset time after the kimchi container is stored, temperature of the first temperature conversion room 32 may be again controlled to a normal temperature range, that is, a temperature range that is applied for normal storage of kimchi.

According to another example, in the case in which a recognized object is canned bear, a storage room corresponding to the recognized object may be the refrigerating room 30. However, the storage room corresponding to the canned beer may change according to temperature of the canned beer, measured by the temperature sensor 130. In response to temperature of the canned beer, measured by the temperature sensor 130, which is higher than or equal to a reference value, the controller 200 may determine a storage room corresponding to the canned beer to be the second temperature conversion room 36. In this case, temperature of the second temperature conversion room 36 may also be controlled based on current temperature of the canned beer.

As described above, because the refrigerator 1 according to an embodiment of the disclosure itself recognizes an object and automatically opens a door, a user carrying the object may himself or herself need not to operate the door, and also, because a door of a storage room being suitable to keep the recognized object is opened, the object may be appropriately kept. In addition, by performing temperature control being suitable for the object, the object may be kept at optimal temperature.

Figure 9:
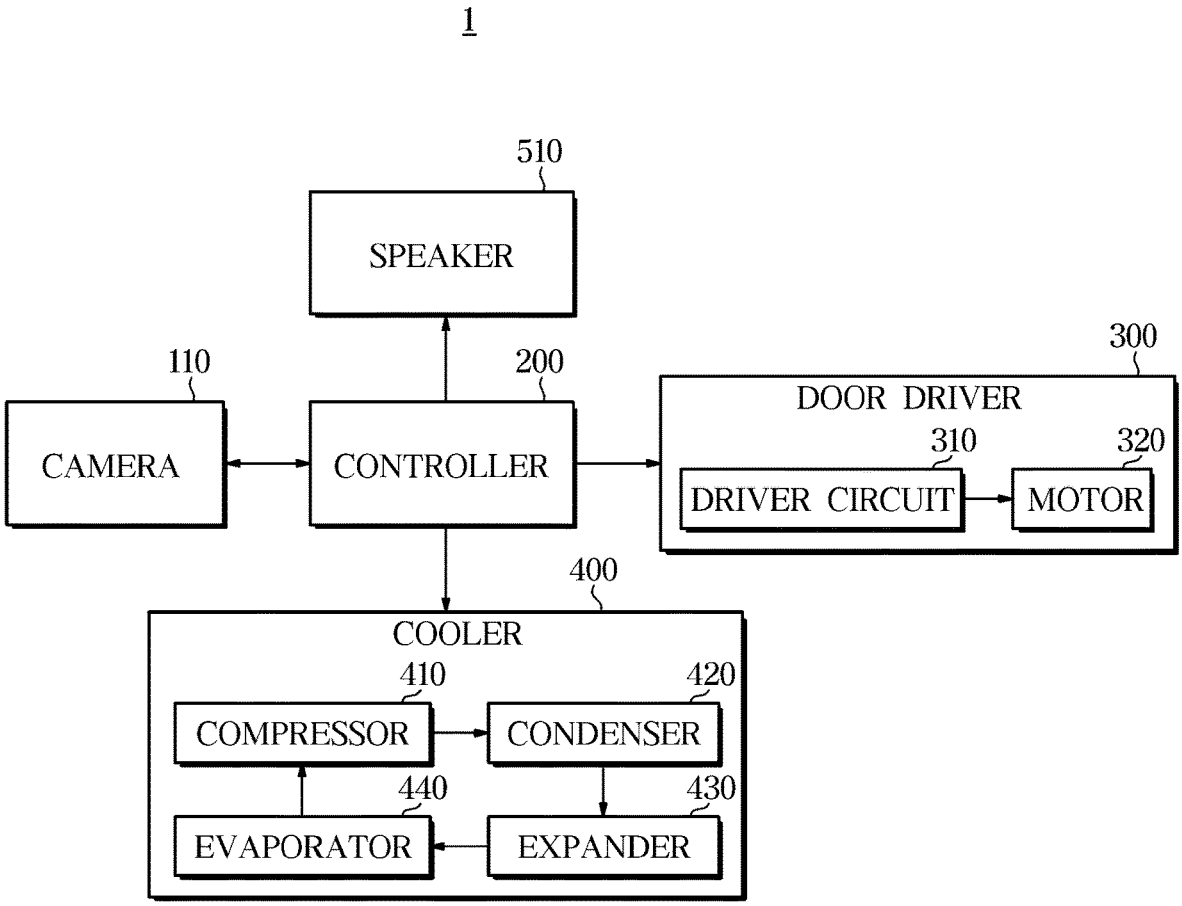
FIG. 9 is a control block diagram of a refrigerator further including a speaker according to an embodiment of the disclosure.
Figure 10:
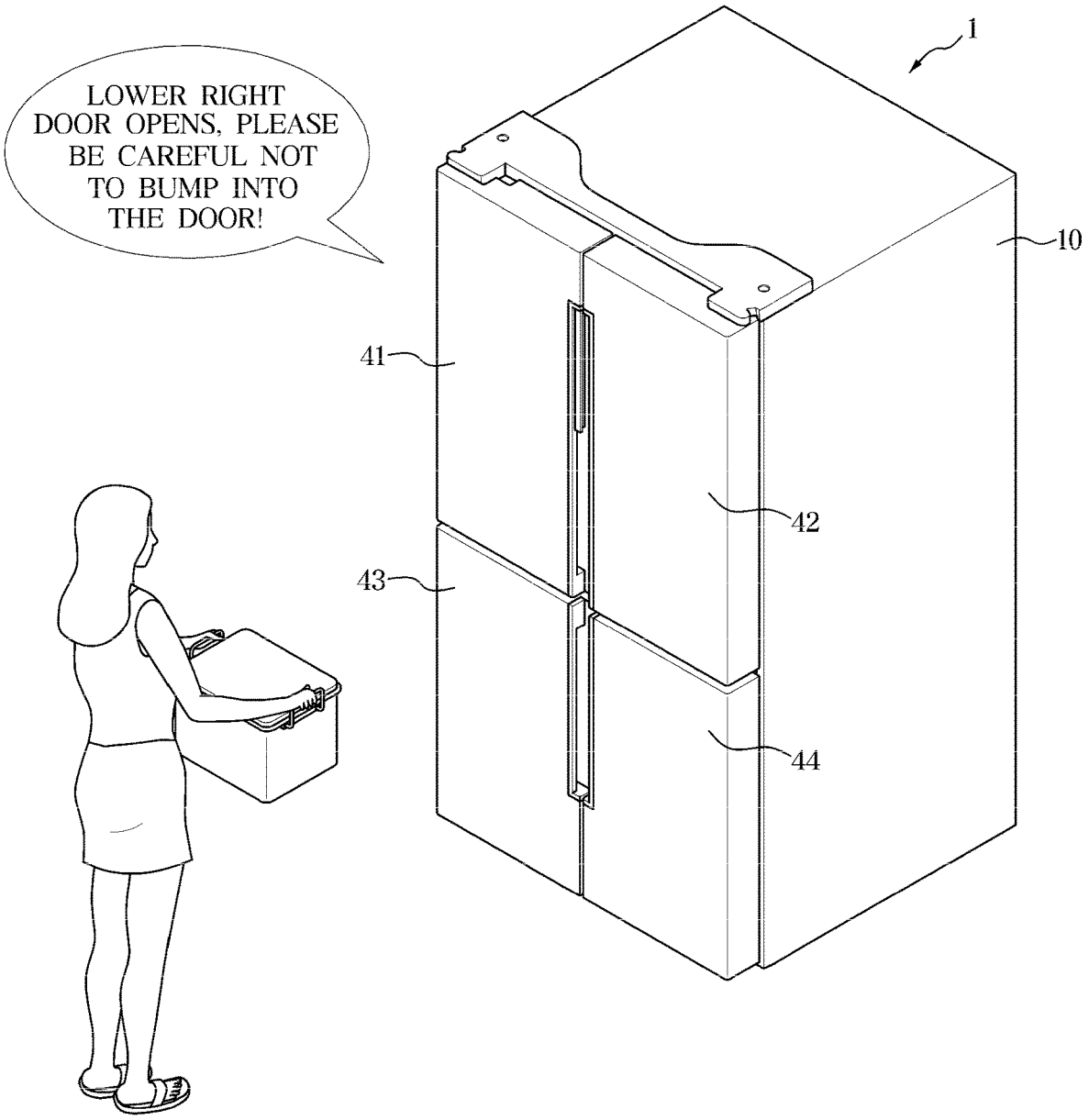
FIGS. 10 and 11 illustrate examples of notification sounds that are output from a speaker of a refrigerator according to an embodiment of the disclosure.
Figure 11:
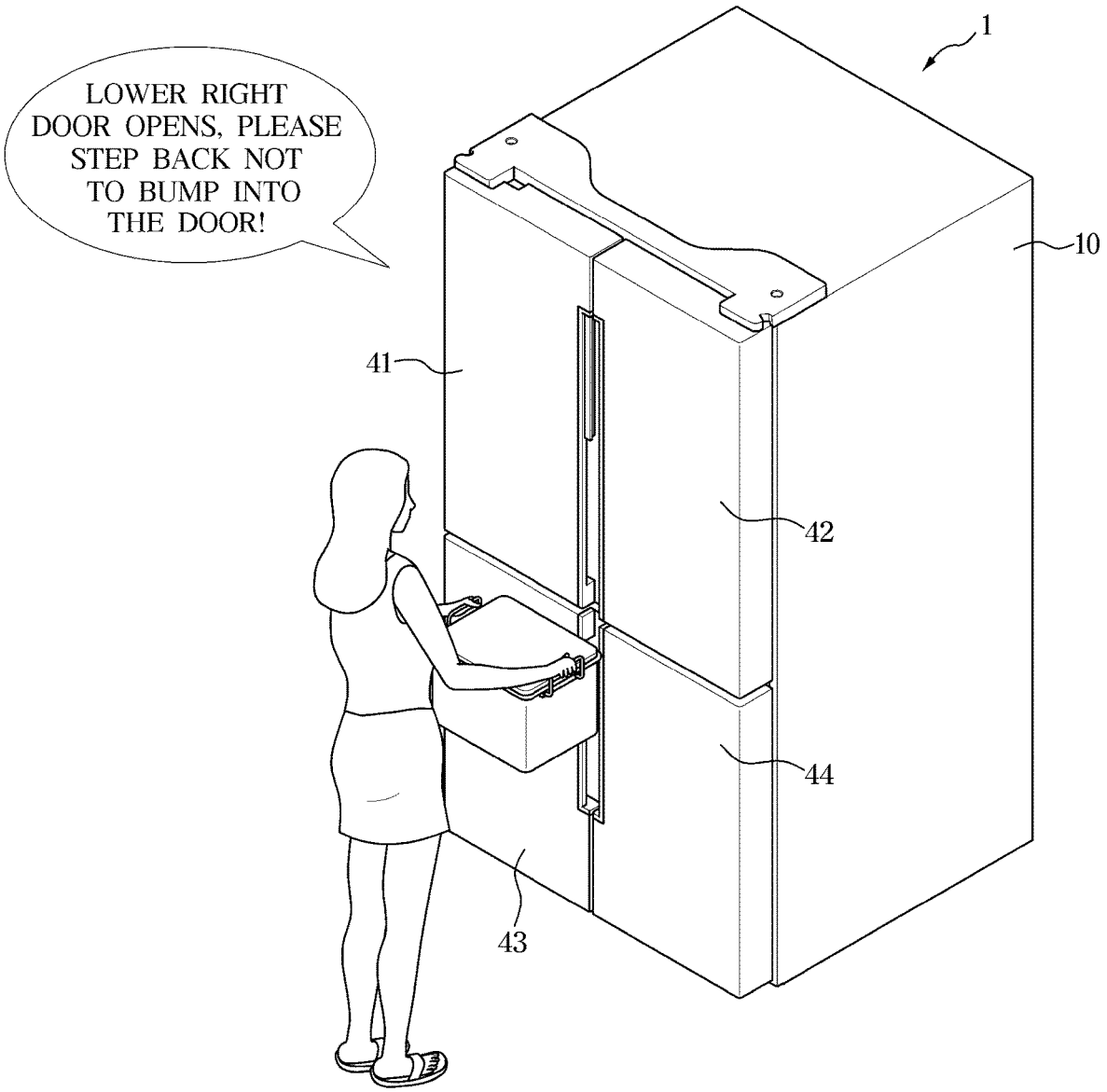

FIG. 9 is a control block diagram of a refrigerator further including a speaker according to an embodiment of the disclosure, and FIGS. 10 and 11 illustrate examples of notification sounds that are output from a speaker of a refrigerator according to an embodiment of the disclosure.

Referring to FIG. 9, the refrigerator 1 according to an embodiment of the disclosure may further include a speaker 510. The speaker 510 may be provided on at least one of the plurality of doors 41, 42, 43, and 44 or on the main body 10.

The controller 200 may control, upon automatic opening of the door 40, the speaker 510 to output a notification sound for notifying a user of the automatic opening of the door 40. Thereby, accidents that may occur upon opening of the door 40 may be prevented in advance.

The notification sound that is output from the speaker 510 may depend on a user's relative location with respect to the door 40 expected to open. The door 40 expected to open may be a door corresponding to an object recognized from an image of surroundings or a door of a storage room corresponding to the object recognized from the image of surroundings.

The controller 200 may determine a user's relative location with respect to the door 40 expected to open, and control the speaker 510 to output a notification sound differently according to the user's relative location.

The user's relative location with respect to the door 40 expected to open may include a direction in which the user is located with respect to the door 40 expected to open, and a distance between the user and the door 40 expected to open.

The controller 200 may determine the user's relative location based on an image of surroundings photographed by the camera 110. Also, in the case in which the refrigerator 1 further includes the proximity sensor 120, the controller 200 may determine the user's relative location based on an output from the proximity sensor 120 or by using both an image of surroundings and an output from the proximity sensor 120.

A warning level of a notification sound may change according to the user's relative location with respect to the door 40 expected to open. In the case in which the user is positioned at a location (collision impossible location) at which he/she will not bump into the door 40 expected to open even after the door 40 opens, the warning level of the notification sound may be set to a first level, and in the case in which the user is positioned at a location (collision possible location) at which he/she may bump into the door 40 expected to open after the door 40 opens, the warning level of the notification sound may be set to a second level.

Referring to FIG. 10, in the case in which a door expected to open is the second lower door 44 and a user is positioned beside the second lower door 44 so that the user will not bump into the second lower door 44 even after the second lower door 44 opens, the warning level of the notification sound may be set to the first level, and accordingly, a notification sound "lower right door opens, please be careful not to bump into the door" may be output through the speaker 510.

Also, in the case in which, although the user is located in front of the second lower door 44, he/she is at a distance from the second lower door 44, at which he/she will not bump into the second lower door 44 after the second lower door 44 opens, the warning level of the notification sound may be still set to the first level.

Referring to FIG. 11, in the case in which a door expected to open is the second lower door 44 and a user is positioned in front of the second lower door 44 at a distance from the second lower door 44 at which the user may bump into the second lower door 44 after the second lower door 44 opens, the warning level of the notification sound may be set to the second level. In this case, a notification sound "lower right door opens, please step back not to bump into the door" may be output through the speaker 510.

With elapse of preset time after the notification sound is output, the controller 200 may transmit a control signal to the door driver 300 to open the door 40 expected to open. However, in the case in which the user has been at a collision possible location, the controller 200 may again determine the user's location after the notification sound is output, and open the door 40 according to a result of a determination that the user moves to be at a collision impossible location. In the case in which the user is still at the collision possible location, the controller 200 may again output the notification sound.

Content of the notification sound output through the speaker 510 is not limited to the above-described example. A notification sound with another content than the above-described example may be output, or melody or a beep sound without any content may be output, as long as the notification sound is output to prevent a collision between the user and the door 40. Also, warning levels of notification sounds may be subdivided into more warning levels than two warning levels.

Meanwhile, the speaker 510 may be used to output a notification sound for other information, in addition to a notification sound for opening the door 40. For example, in the case in which an object appearing on an image of surroundings is not properly recognized, a notification sound may be output through the speaker 510. More particularly, in the case in which, although the camera 110 is activated in response to a user's approach to photograph an image of surroundings, no object is recognized, or it fails to determine what a recognized object is although existence of the object is recognized, the controller 200 may control the speaker 510 to output a notification sound. The notification sound may be output as a voice including information indicating that an object has not been properly recognized, or as melody or a beep sound.

Alternatively, there may be a case in which a user moves to be far away from the refrigerator 1 in the state in which object recognition of the refrigerator 1 is not completed or the door 4 does not open completely. In this case, the controller 200 may control the speaker 510 to output a notification sound. The notification sound may be output as a voice including information indicating that object recognition is not completed or the door 40 does not open completely, or as melody or a beep sound. In the case in which the notification sound is output as a beep sound, greater strength of the beep sound may be output as the user moves farther away from the refrigerator 1.

The refrigerator 1 may include an inputter for turning on/off the speaker 510. A user who does not want to hear a notification sound output from the speaker 510 may operate the inputter to turn off the speaker 510.

The controller 200 may store exception cases, such as a case in which the refrigerator 1 fails to recognize an object, and provide a user with history information about the exception cases. The user may check the history information about the exception cases through a display 520 (see FIG. 17) provided on the refrigerator 1 or through a mobile device equipped with a display, such as a mobile phone or a tablet PC.

Also, the refrigerator 1 may receive a feedback from a user to obtain information about an object not recognized, and the obtained information may be used for object recognition which will be performed later.

Figure 12:
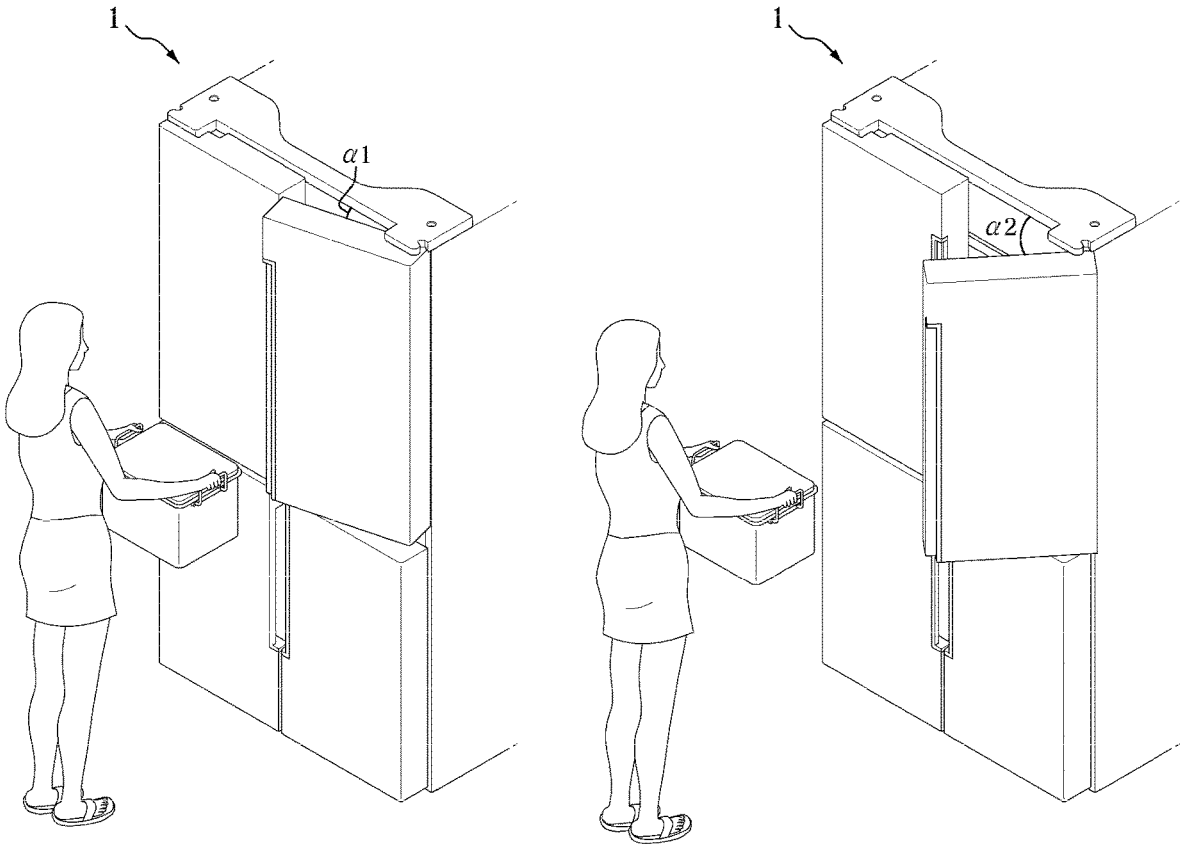
FIG. 12 illustrates an example of a refrigerator that adjusts an opening angle of a door based on a relative position between the door and a user according to an embodiment of the disclosure.

FIG. 12 illustrates an example of a refrigerator that adjusts an opening angle of a door based on a relative position between the door and a user according to an embodiment of the disclosure.

Referring to FIG. 12, the refrigerator 1 according to an embodiment of the disclosure may control an opening angle of the door 40 expected to open, based on a user's relative location with respect to the door 40, to prevent a collision between the door 40 and the user.

The controller 200 may determine a user's relative location with respect to the door 41 expected to open, according to the above-described method, and according to a result of determination that the user is at a location at which he/she may collide with the door 41 expected to open, the controller 200 may open the door 41 to an angle $\alpha 1$ at which the door 41 will not collide with the user, as shown in FIG. 12.

The controller 200 may calculate an opening angle of the door 41 based on the user's relative location, a length of the door 41, etc., or store the opening angle of the door 41 corresponding to the user's relative location in advance. In the latter case, the controller 200 may classify opening angles of the door 41 into three levels of 30 degrees, 60 degrees, and 90 degrees, store the three levels, and control an opening angle of the door 41 to one of the three levels according to the user's relative location.

Also, in the case in which the user is at a location at which he/she will not bump into the door 41 expected to open, the controller 200 may open the door 41 to an opening angle $\alpha 2$ set to a default value regardless of the user's relative location.

The opening angle $\alpha 2$ set to the default value may depend on a storage room or may be a fixed value regardless of a storage room.

In the former case, in the case in which a storage room corresponding to a recognized object is a storage room provided on the rear surface of the door 41, 42, 43, or 44, the door 41 may open to a greater opening angle than the case in which the storage room corresponding to the recognized object is a storage room provided in the main body 10.

In the latter case, the door 41 may open to a maximum opening angle regardless of a storage room corresponding to a recognized object. Also, the controller 200 may open the door 41 to an angle that is smaller than the maximum opening angle, and allow a user to widely open the door 41 with his/her body.

Also, the user may change the opening angle $\alpha 2$ set to the default value or select an opening angle that is to be set to a default value, through the inputter provided in the refrigerator 1.

Meanwhile, the refrigerator 1 may control opening speed of the door 40, in addition to the opening angle of the door 40. The opening speed of the door 40 may be controlled according to a user's relative location. For example, as a user's relative location is closer to the door 40, the refrigerator 1 may control the door 40 to open at low opening speed to provide the user with time for which he/she will avoid the door before bumping into the door 40.

The controller 200 may calculate opening speed of the door 40 based on a user's relative location, a length of the door 40, etc., or store opening speed of the door corresponding to a user's relative location in advance. As an example of the latter case, the controller 200 may classify opening speed of the door 40 into three levels, store the three levels, and control opening speed of the door 40 to one level of the three levels according to a user's relative location.

Alternatively, the controller 200 may control opening speed of the door according to a user's selection. In this case, the user may select one level from among a plurality of levels indicating opening speed of the door 40, change opening speed of the door 40 set to a default value, or input a value of opening speed of the door 40.

The above-described examples have been described under an assumption that an object recognized from an image of surroundings is an object to be stored in the refrigerator 1 by a user. However, in an embodiment of the refrigerator 1, an object recognized from an image of surroundings may be an object to be taken out of the refrigerator 1 by a user.

For example, in the case in which an object recognized from an image of surroundings is an empty cup, an object to be taken out of the refrigerator 1 by a user may be a liquid, such as bottled water, milk, and a drink, and in the case in which an object recognized from an image of surroundings is an empty kimchi container, an object to be taken out of the refrigerator 1 by a user may be kimchi.

In the above-described example, a description that the controller 200 may store information about storage rooms corresponding to individual objects in advance has been given. In the above-described example, a storage room corresponding to an object is a storage room that is suitable to store the corresponding object. However, in the current example, a storage room corresponding to an object may be a storage room storing an object related to the corresponding object or estimated to store the related object.

For example, in the case in which an object recognized from an image of surroundings is an empty cup, an object related to the empty cup may be bottled water or a drink, and a storage room corresponding to the empty cup may be a storage room storing liquids, such as bottled water and drinks.

Also, in the case in which an object recognized from an image of surroundings is an empty kimchi container or an empty side dish container, an object related to the empty kimchi container or the empty side dish container may be kimchi, and a storage room corresponding to the empty kimchi container or the empty side dish container may be the second temperature conversion room 36 storing kimchi.

As described above, such information may be stored in advance in the controller 200, and the information stored in the controller 200 may be updated according to a use history of the refrigerator 1. Also, the information may be obtained from the server 800 that manages a plurality of refrigerators.

Also, in the case in which the refrigerator 1 includes the internal sensor 150, a storage room in which an object corresponding to an object recognized from an image of surroundings is stored may be determined based on an output of the internal sensor 150, which will be described later.

Figure 13:
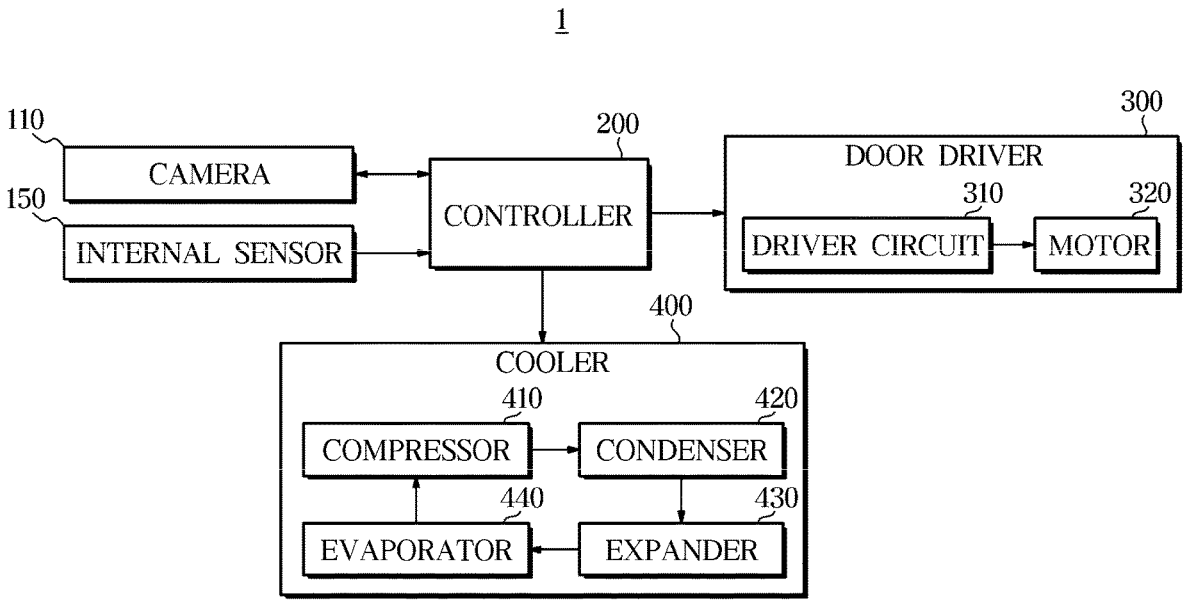
FIG. 13 is a control block diagram of a refrigerator further including an internal sensor according to an embodiment of the disclosure.

FIG. 13 is a control block diagram of a refrigerator further including an internal sensor according to an embodiment of the disclosure.

Referring to FIG. 13, the refrigerator 1 according to an embodiment of the disclosure may further include the internal sensor 150 provided inside the refrigerator 1 to obtain various information related to storage rooms.

For example, the internal sensor 150 may include at least one of a weight sensor that senses a weight of an object kept on a shelf provided in at least one of the plurality of storage rooms 30, 31, 32, and 33, a distance sensor that senses an empty space of at least one of the plurality of storage rooms 30, 31, 32, and 33, or an internal camera that obtains an inside image of the refrigerator 1.

The controller 200 may determine whether a storage room corresponding to an object recognized from an image of surroundings is capable of accommodating the recognized object, based on an output of the internal sensor 150. Also, the controller 200 may further use an image of surroundings photographed by the camera 110 to determine whether the storage room corresponding to the recognized object is capable of accommodating the recognized object.

More particularly, the controller 200 may calculate a size of the recognized object from the image of surrounding, and calculate an available space of the storage room corresponding to the recognized object based on an output of the internal sensor 150. The controller 200 may compare the size of the recognized object with the available space of the storage room corresponding to the recognized object to determine whether the storage room is capable of accommodating the recognized object.

In the case in which the controller 200 determines that the storage room corresponding to the recognized object is capable of accommodating the recognized object, the controller 200 may automatically open a door of the storage room corresponding to the recognized object, as described above, and in the case in which the controller 200 determines that the storage room corresponding to the recognized object is incapable of accommodating the recognized object, the controller 200 may provide the user with information related to a result of the determination.

In the case in which the refrigerator 1 includes the speaker 510, a guide message related to the result of the determination may be output through the speaker 510. The guide message related to the result of the determination may include information indicating that the storage room corresponding to the recognized object does not have enough available space, and suggest, in the case in which there is another refrigerator in the user's home, the user to keep the recognized object in the other refrigerator.

In the case in which the refrigerator 1 further includes the display 520 (see FIG. 17), the guide message related to the result of the determination may be output through the display 520, which will be described later.

Meanwhile, an output of the internal sensor 150 may be used to automatically close the door 40 or deactivate the camera 110. After the door 40 automatically opens as described above, the user may again close the door 40 manually. However, the controller 200 may automatically close the door 40, and at this time, the controller 200 may use an output of the internal sensor 150. More particularly, after the door 40 of the storage room corresponding to the recognized object opens, the controller 200 may determine whether an object has been added in the storage room corresponding to the recognized object based on an output of the internal sensor 150, and according to a result of a determination that an object has been added, the controller 200 may transmit a control signal for automatically closing the door 40 to the door driver 300.

Also, according to the result of the determination that the object has been added, the controller 200 may deactivate the camera 110.

However, an embodiment of the refrigerator 1 is not limited to this, and the controller 200 may close the door 40 automatically or deactivate the camera 110 upon elapse of preset time after the door 40 opens, regardless of an output of the internal sensor 150.

Meanwhile, the controller 200 may recognize a user, as well as an object, from an image of surroundings. To recognize a user, the user's features, for example, the user's physical features (e.g., height, body type, the length of hair, the size of face, etc.) or the user's other external features (e.g., whether the user wears glasses, whether the user uses a stick or wheelchair, etc.) may have been stored in advance in the controller 200. In the case in which a plurality of users, for example, a plurality of family members uses the refrigerator 1, the individual users' features may be stored individually.

The controller 200 may compare a feature detected from an image of surroundings with the features stored in advance to recognize a user appearing in the image of surroundings, and control the door 40 to open based on the recognized user. More particularly, the controller 200 may have matched individual users with storage rooms preferred by the respective users and stored results of the matching in advance. For example, user 1 may prefer to store a certain object in the refrigerating room 30 and user 2 may prefer to store the same object in the first temperature conversion room 32. The results of the matching may have been stored in advance in the controller 200, and the controller 200 may open a door of a storage room matching with a recognized user.

Also, the controller 200 may have matched individual users with storage temperature preferred by the respective users and stored results of the matching in advance. For example, in the case in which a storage room corresponding to an object recognized from an image of surroundings is the first temperature conversion room 32 or the second temperature conversion room 36, the controller 200 may control temperature of the first temperature conversion room 32 or the second temperature conversion room 36 according to storage temperature matching with a user recognized from the image of surroundings.

Information about storage rooms or storage temperature preferred by individual users may be stored at the time of manufacturing the refrigerator 1, may be acquired from the server 800, or may be updated according to a use history of the refrigerator 1.

Also, an opening angle or opening speed of the door 40 may be controlled according to a recognized user. For example, the controller 200 may control the door 40 to open more slowly for a recognized older user and open to a greater opening angle for a recognized larger user.

The controller 200 may recognize a user by using the user's voice input to a microphone 140. The controller 200 may have registered each user's voice in advance, extracted and stored a feature of the user's voice, and then compare a feature extracted from a voice input to the microphone 140 with the stored feature to recognize the user. Operations that are performed by the controller 200 after the controller 20 recognizes the user have been described above.

The above-described operation related to user recognition may be performed by the server 800.

Figure 14:
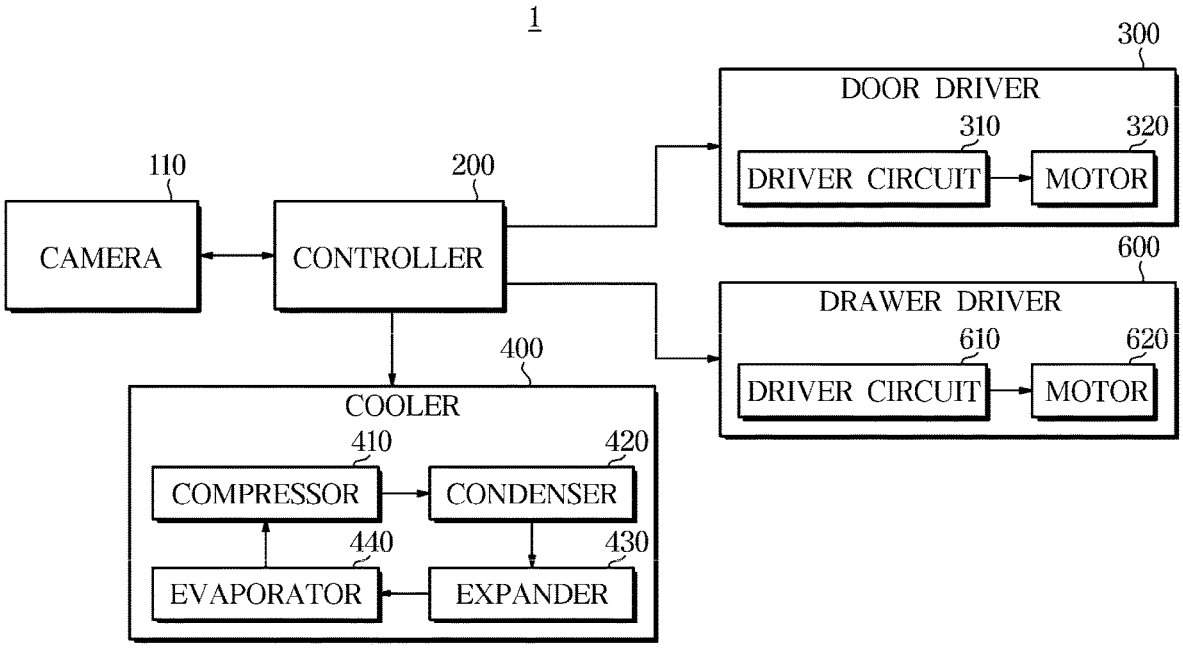
FIG. 14 is a control block diagram of a refrigerator further including a drawer driver according to an embodiment of the disclosure.

FIG. 14 is a control block diagram of a refrigerator further including a drawer driver according to an embodiment of the disclosure.

As described above, the refrigerator 1 according to an embodiment of the disclosure may include at least one drawer 39 provided in at least one of the plurality of storage rooms 30, 31, 32, and 33, and according to an example of the refrigerator 1, the at least one drawer 39 may be automatically inserted into or taken out of the at least one storage room.

For this, as shown in FIG. 14, the refrigerator 1 according to an embodiment of the disclosure may further include a drawer driver 600 that generates power for automatically taking the drawer 39 out or inserting the drawer 39. The drawer driver 600 may include a motor 620 for generating power and a driver circuit 610 for driving the motor 620.

In the case in which the drawer 39 is provided in a storage room corresponding to a recognized object, the controller 200 may transmit a control signal for automatically taking the drawer 39 out to the drawer driver 600. A user may manually insert the drawer 39 into the storage room after storing the object, or the controller 200 may automatically insert the drawer 39 into the storage room upon elapse of preset time after automatically taking the drawer 39 out. Also, in the case in which the internal sensor 150 is provided, the controller 200 may determine whether the object has been accommodated in the drawer 39 based on an output of the internal sensor 150, and according to a result of a determination that the object has been accommodated in the drawer 39, the controller 200 may automatically insert the drawer 39 into the storage room.

By automatically taking the drawer 39 provided in the storage room out, a user's convenience may be further improved.

Figure 15:
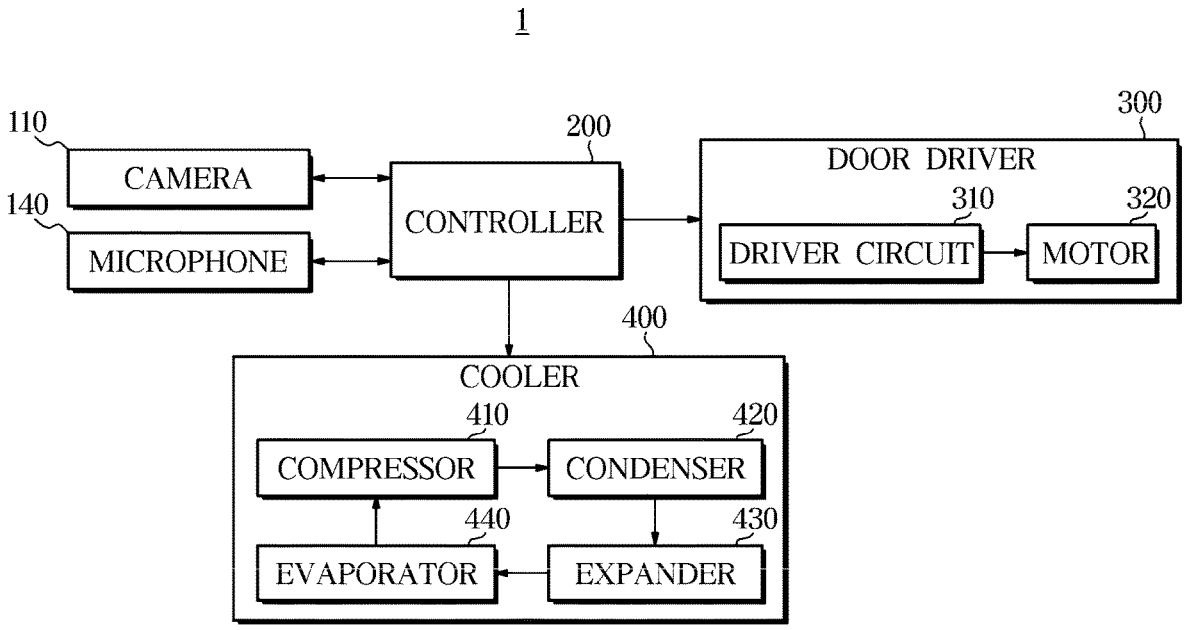
FIG. 15 is a control block diagram of a refrigerator further including a microphone according to an embodiment of the disclosure.
Figure 16:
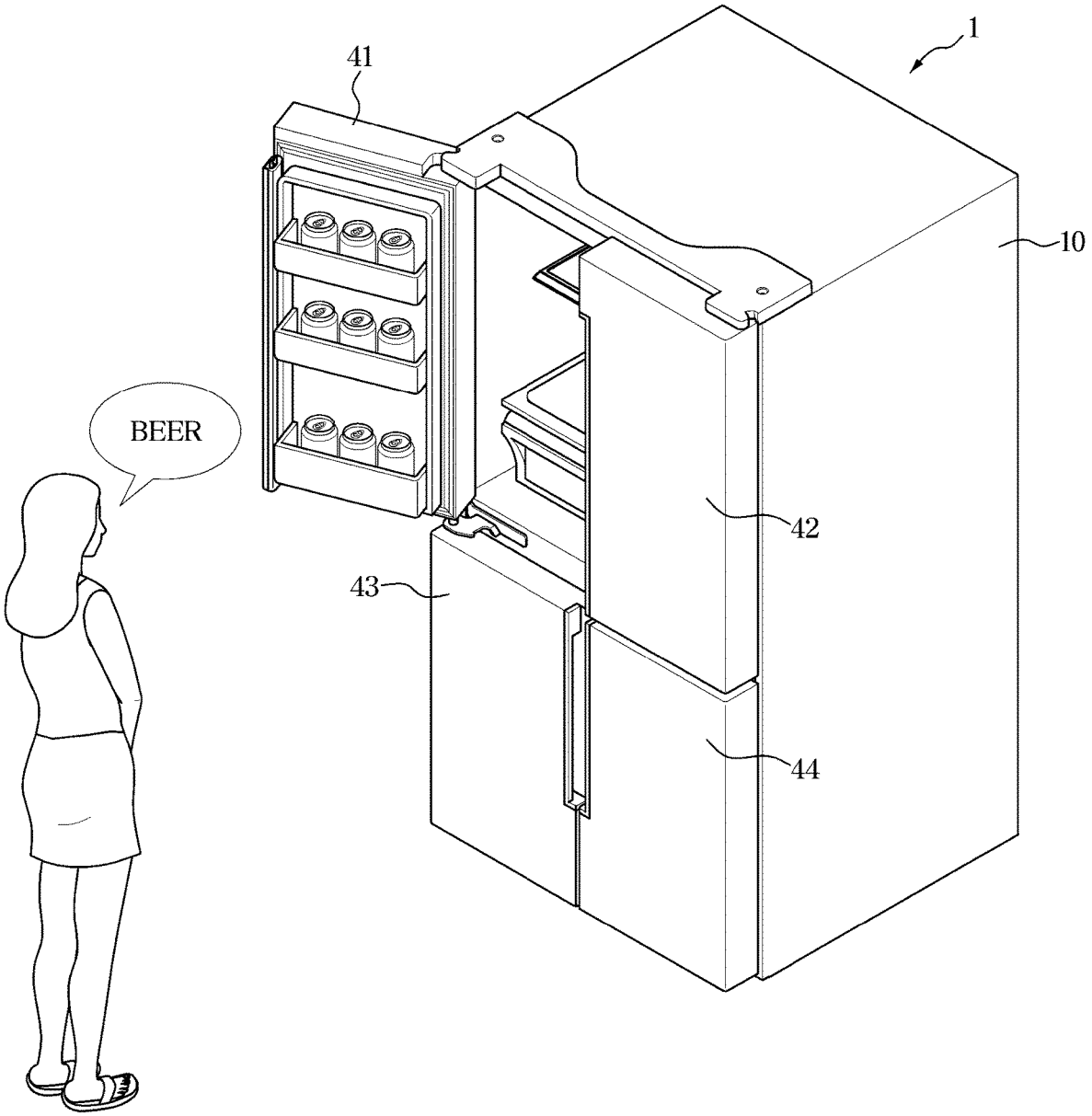
FIG. 16 illustrates an example of recognizing an object from a voice input by a user through a microphone according to an embodiment of the disclosure.

FIG. 15 is a control block diagram of a refrigerator further including a microphone, and FIG. 16 illustrates an example of recognizing an object from a voice input by a user through a microphone according to an embodiment of the disclosure.

Referring to FIG. 15, the refrigerator 1 according to an embodiment of the disclosure may further include the microphone 140. The microphone 140 may be attached on an outer surface of the refrigerator 1 to receive a user's voice.

As described above, there may be a case in which, although the controller 200 activates the camera 110 based on an output of the proximity sensor 120 and applies an object recognition algorithm to an image of surroundings photographed by the camera 110, the controller 200 fails to recognize any preset object. In this case, the controller 200 may trigger voice recognition.

In the case in which the microphone 140 is in a turned-on state, the controller 200 may trigger voice recognition, and in the case in which the microphone 140 is in a turned-off state, the controller 200 may turn on the microphone 140 and then trigger voice recognition. That is, in the case in which an output of the proximity sensor 120 represents a user's approach, and no preset object is recognized from an image of surroundings, voice recognition may trigger although a wake-up word or trigger word for voice recognition is not uttered.

The controller 200 may transmit, in response to a name of an object recognized from a user's voice input to the microphone 140, a control signal for opening the door 40 to the door driver 300 based on the recognized name of the object.

More particularly, a user may utter a name of an object which he/she intends to take out of the refrigerator 1 to input the name of the object to the microphone 140, and the controller 200 may determine a storage room storing the corresponding object or estimated to store the corresponding object. The storage room storing the corresponding object may be determined based on an output of the internal sensor 150, and the storage room estimated to store the corresponding object may be determined based on information stored in a memory of the controller 200 or the server 800.

Referring to FIG. 16, in the case in which, although a user approaches the refrigerator 1 so that the camera 110 is activated and photographs an image of surroundings, no preset object is recognized from the image of surroundings, the controller 200 may trigger voice recognition. Then, the user may utter "beer" with the user's voice to input the "beer" to the microphone. In this case, voice recognition may be performed on the user's voice. The voice recognition may be performed directly by the controller 200, or an external server may perform voice recognition and transmit a result of the voice recognition to the refrigerator 1.

For example, the controller 200 may determine a storage room storing or estimated to store beer which is an object having the name uttered by the user to be the refrigerating room 30, and transmit a control signal for opening the first upper door 41 to the door driver 300.

As described above, information about storage rooms corresponding to objects may have been stored in advance in the controller 200, the information stored in the controller 200 may be updated according to a use history of the refrigerator 1, or the information may be obtained from the server 80 that manages a plurality of refrigerators.

Also, in the case in which the refrigerator 1 includes the internal sensor 150, a storage room storing an object having a name uttered by a user may be determined based on an output of the internal sensor 150.

Also, there may be a case in which the controller 200 fails to recognize what an object carried by a user is. In the case in which the controller 200 recognizes that a user carries an object from an image of surroundings, but fails to recognize what the corresponding object is, the controller 200 may determine a name of an object, uttered by the user, as a name of the corresponding object. Accordingly, the controller 200 may determine a storage room corresponding to the object having the name uttered by the user, that is, a storage room that is suitable to store the object having the name uttered by the user, and transmit a control signal for opening the door 40 of the determined storage room to the door driver 300.

The controller 200 may match a feature, such as a shape, size, color, etc., of the object recognized from the image of surroundings with the name of the object, uttered by the user, and store a result of the matching. In the case in which the controller 200 is capable of performing deep learning, a feature of an object recognized from an image of surroundings, and a name of the object, uttered by a user, may be used as learning data. Thereafter, in the case in which an image of surroundings includes an object having the same feature, the controller 200 may recognize what the corresponding object is. Alternatively, in the case in which the server 800 performs object recognition, the server 800 may perform the operation.

Meanwhile, there may be a case in which it is obscure whether an object carried by a user is an object to be stored in the refrigerator 1 or to be taken out of the refrigerator 1. That is, in the case in which an object recognized by the controller 200 from an image of surroundings is an object being storable in the refrigerator 1 and related to an object stored in the refrigerator 1, the controller 200 may turn on the microphone 140 or activate voice recognition to obtain additional information from a user.

The controller 200 may determine whether the object recognized from the image of surroundings is an object to be stored in the refrigerator 1 or an object related to an object to be taken out of the refrigerator 1, based on a name of the object, included in the user's voice input to the microphone 140.

In the case in which the name of the object, included in the user's voice, is identical to the object recognized from the image of surroundings, the controller 200 may determine that the recognized object is an object to be stored in the refrigerator 1, and open the door 40 of a storage room that is suitable to store the object.

In the case in which the name of the object, included in the user's voice, is not identical to the object recognized from the image of surroundings, the controller 200 may determine that the recognized object is an object related to an object to be taken out of the refrigerator 1, and open the door 40 of a storage room storing an object having the name included in the user's voice.

For example, in the case in which a user carries an empty beer glass, the user's intention may be an intention for keeping the beer glass cool or an intention for taking beer out of the refrigerator 1. Accordingly, in the case in which an empty beer glass is recognized from an image of surroundings, the controller 200 may turn on the microphone 140 or activate voice recognition to receive the user's voice. In the case in which a name of an object, included in the user's voice, is "beer glass", the controller 200 may open the door 40 to enable the user to store the beer glass, and in the case in which the name of the object, included in the user's voice, is "beer", the controller 200 may open the door 40 to enable the user to take beer out.

Figure 17:
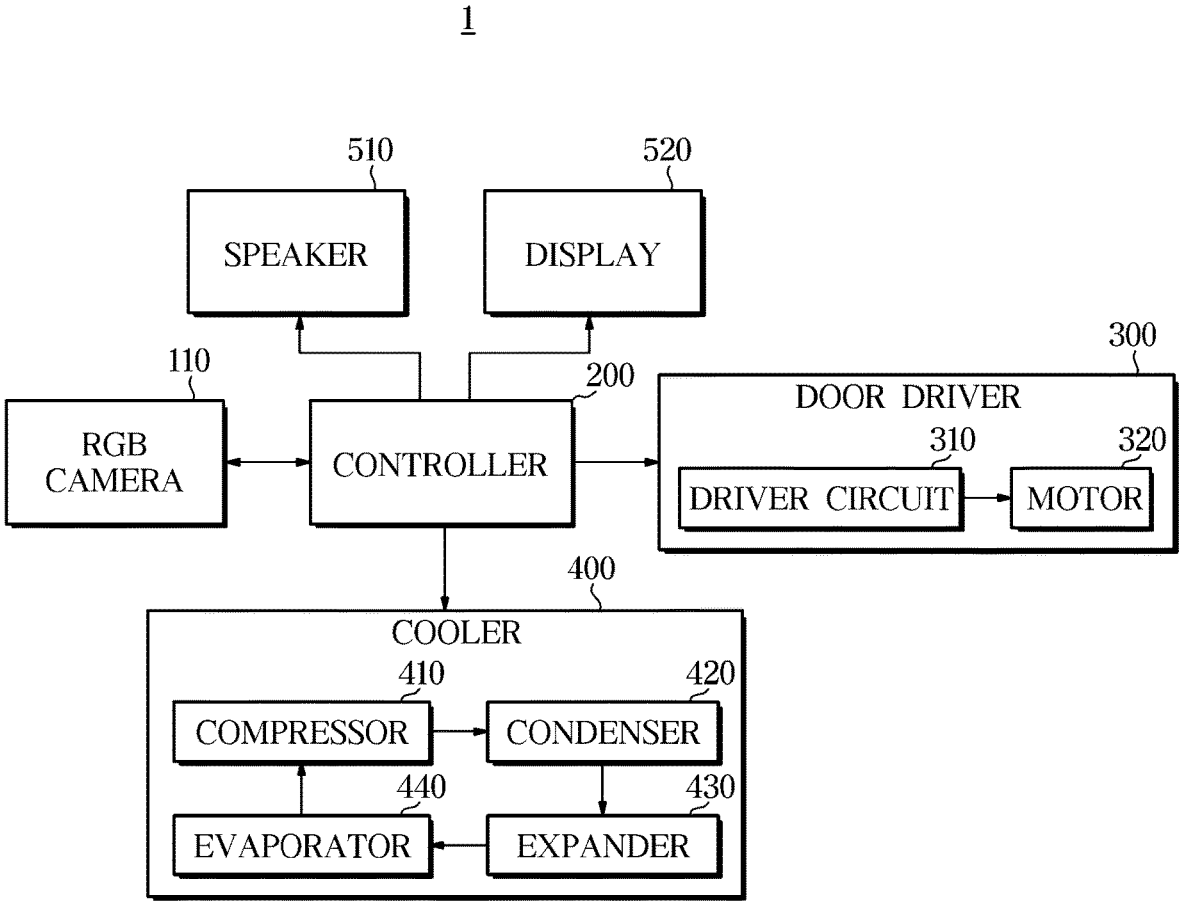
FIG. 17 is a control block diagram of a refrigerator further including a display according to an embodiment of the disclosure.
Figure 18:
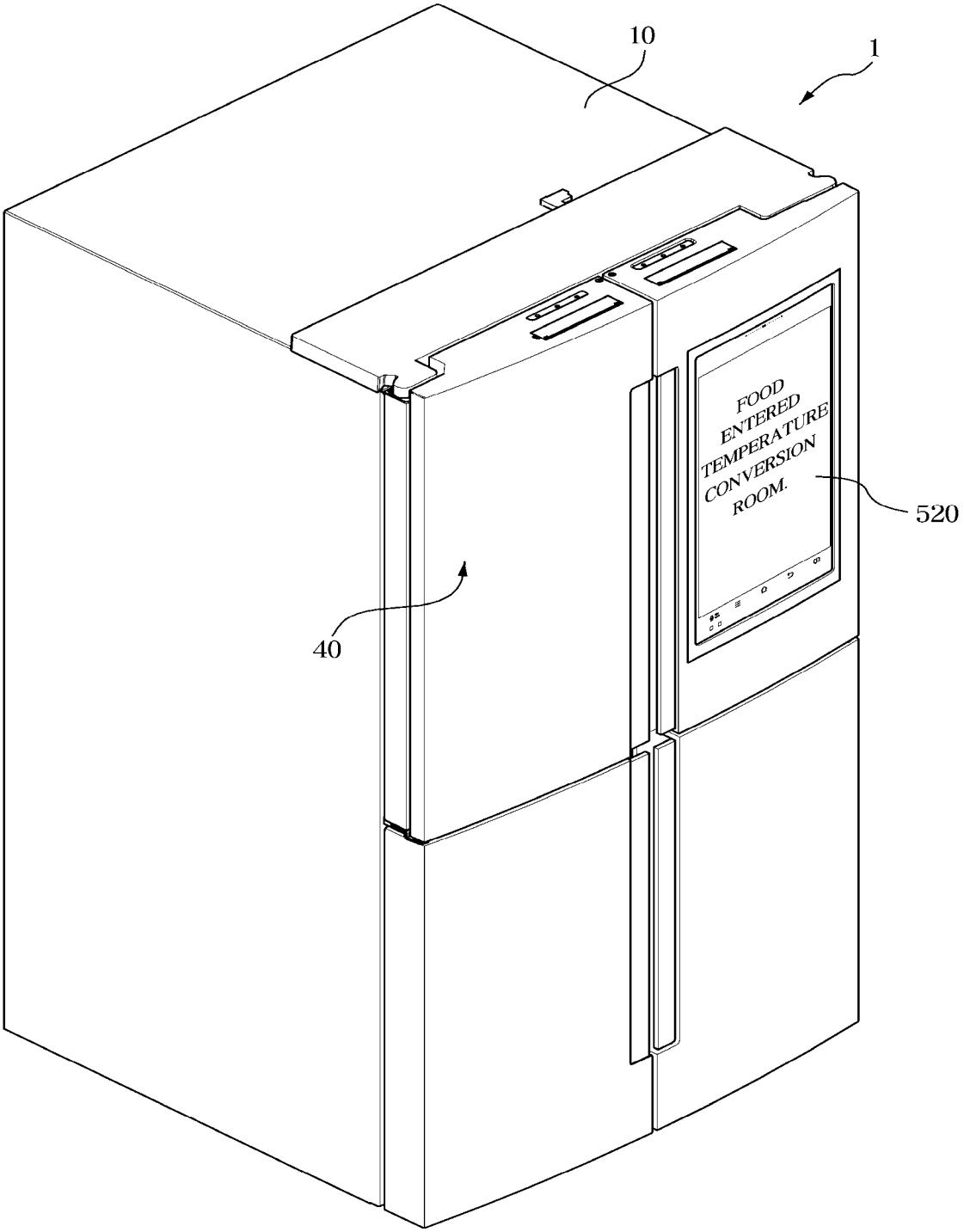
FIG. 18 illustrates an example of a screen displayed on a display of a refrigerator according to an embodiment of the disclosure.

FIG. 17 is a control block diagram of a refrigerator further including a display, and FIG. 18 illustrates an example of a screen displayed on a display of a refrigerator according to an embodiment of the disclosure.

Referring to FIGS. 17 and 18, the refrigerator 1 may further include the display 520 provided on the door 40.

The display 520 may be one of various types of displays including a Liquid Crystal Display (LCD) panel, a Light Emitting Diode (LED) panel, an Organic Light Emitting Diode (OLED) panel, and a Quantum Dot LED (QLED) panel.

The display 520 may be positioned on one of the plurality of doors 40, as shown in FIG. 18, or a plurality of displays 520 may be respectively positioned on the individual doors 40.

In the case in which an object enters at least one of the plurality of storage rooms or is released from at least one of the plurality of storage rooms, the controller 200 may control the display 520 to display information related to the entrance or release.

Referring to FIG. 18, in the case in which food enters a temperature conversion room, the display 520 may display information indicating that food has entered the temperature conversion room. The display 520 may display information related to entrance and release of food as text, as shown in FIG. 18, or as an image.

Alternatively, as described above with reference to FIG. 13, in the case in which it is determined that a storage room corresponding to an object recognized from an image of surroundings is incapable of accommodating the recognized object because an available space of the storage room is not enough, the display 520 may display a guide message related to a result of the determination. For example, the display 520 may display information indicating that the storage room corresponding to the recognized object does not have enough available space, or the display 520 may display, in the case in which there is another refrigerator in the user's home, information for suggesting the user to keep the recognized object in the other refrigerator.

The information may be displayed on the user's mobile device. In this case, the refrigerator 1 or the server 800 managing the refrigerator 1 may transmit the information to the user's mobile device through a communicator (e.g., a transceiver), and the user's mobile device may display the information.

Figure 19:
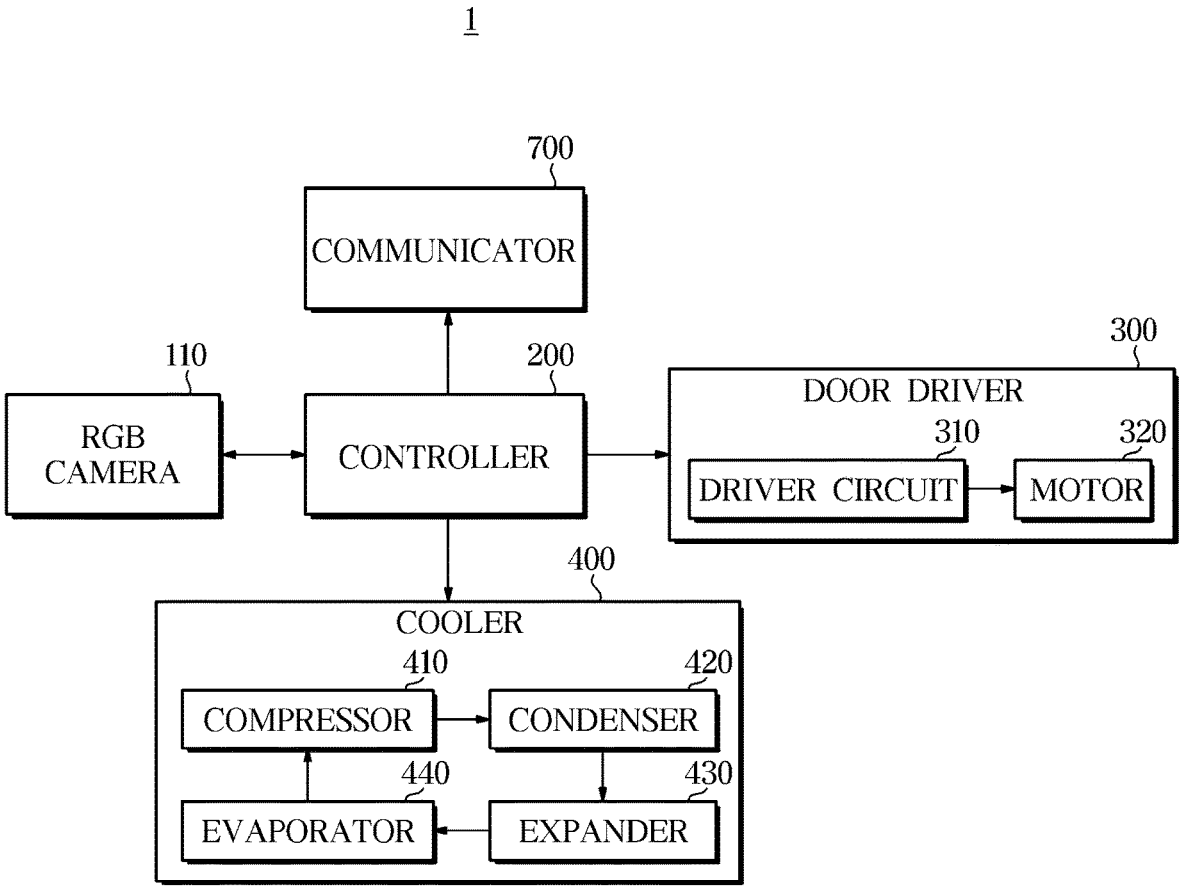
FIG. 19 is a control block diagram of a refrigerator further including a transceiver according to an embodiment of the disclosure.
Figure 20:
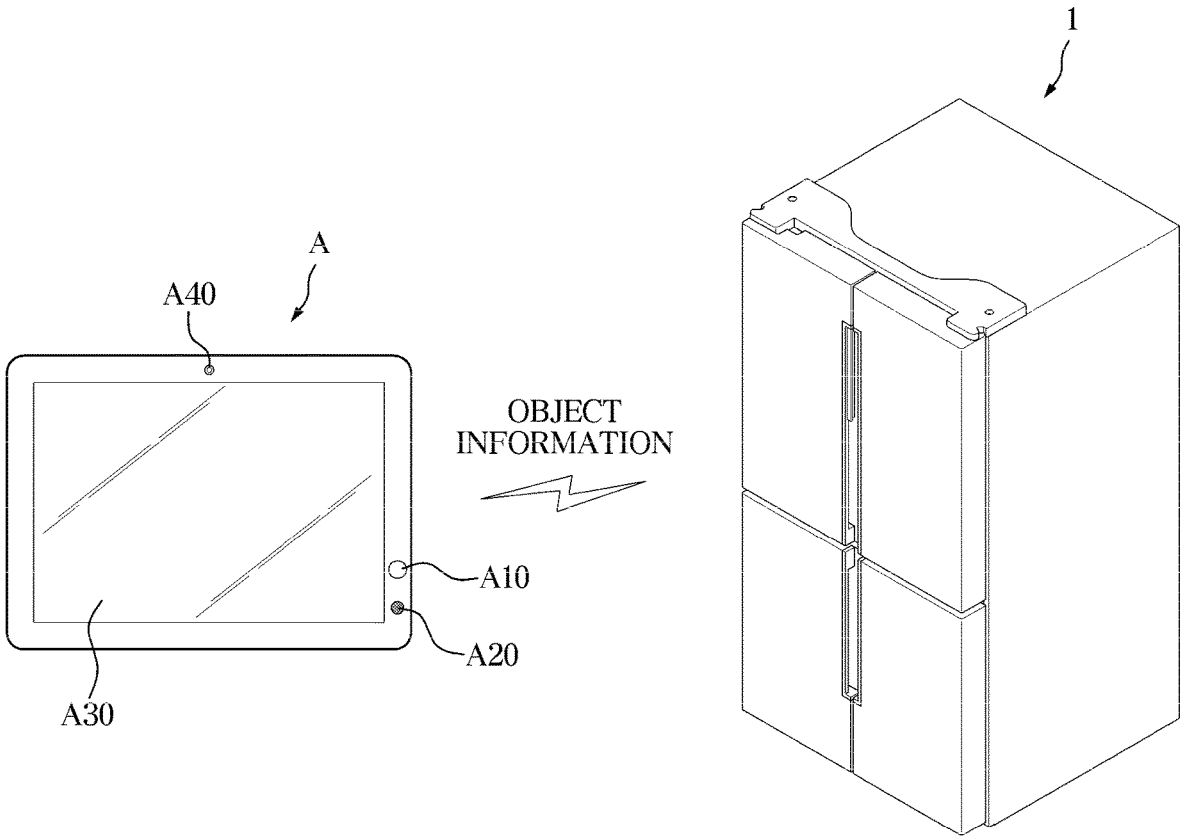
FIGS. 20 to 22 illustrate examples of external devices that communicate with a refrigerator according to various embodiments of the disclosure.
Figure 21:
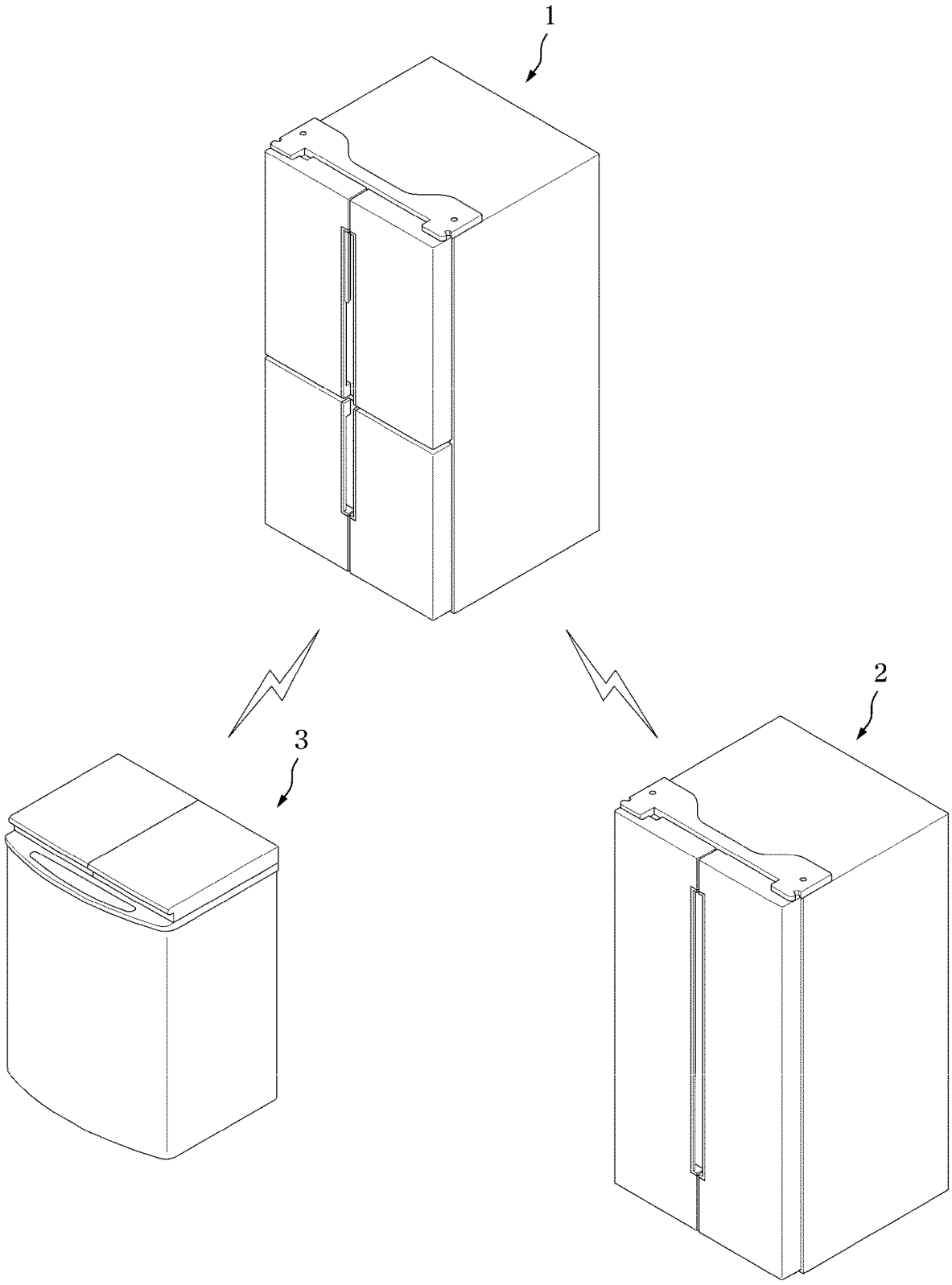
Figure 22:
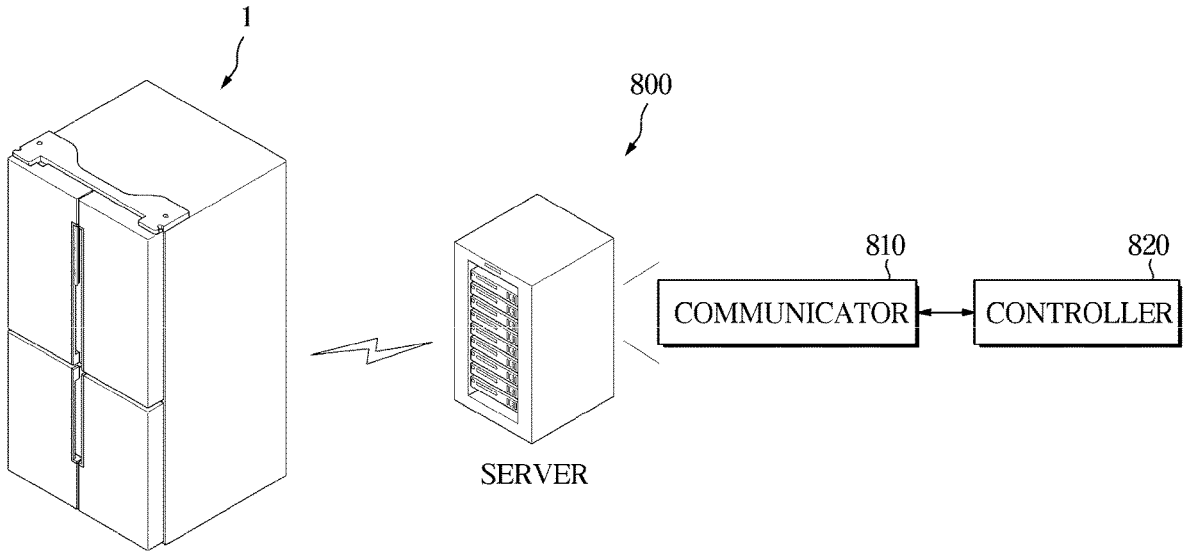

FIG. 19 is a control block diagram of a refrigerator further including a communicator, and FIGS. 20 to 22 illustrate examples of external devices that communicate with a refrigerator according to an embodiment of the disclosure.

Referring to FIG. 19, the refrigerator 1 according to an embodiment of the disclosure may further include a communicator 700 (e.g., a transceiver) for communicating with an external device.

The communicator 700 may include at least one of a short-range communication module using a method, such as Wireless-Fidelity (Wi-Fi), Zigbee, or Near Field Communication (NFC), a wireless communication module using a method, such as $3^{rd}$ generation (3G), $4^{th}$ generation (4G), or $5^{th}$ generation (5G), or a wired communication module using a communication cable.

The communicator 700 may communicate with at least one of a mobile device, another appliance in home, or a server to transmit/receive data.

The mobile device may include a portable and communicable electronic device, such as a user's mobile phone and a tablet PC. The communicator 700 may directly communicate with the mobile device to transmit/receive data to/from the mobile device, or the communicator 700 may transmit/receive data to/from the mobile device through the server 800 managing the refrigerator 1. Information displayed on the display 520 of the refrigerator 1, as described above with reference to FIGS. 17 and 18, may be displayed on a mobile device. To display information on a mobile device registered in advance, the controller 200 may transmit the corresponding information to the mobile device through the communicator 700.

Referring to FIG. 20, the refrigerator 1 may transmit/receive data to/from an Artificial Intelligence (AI) speaker A which is one of other appliances located in home and including a camera, through the communicator 700. In the current example, the AI speaker A is described as an example, however, other appliances, such as a television (TV), a computer, a robot cleaner, etc., may also be included in the other appliances located in home and including the camera.

The AI speaker A may include a speaker A10, a microphone A20, a camera A40, and a display A30.

The AI speaker A may transmit an image photographed by the camera A40 to the refrigerator 1, recognize an object from the image photographed by the camera A40, and transmit information about the recognized object to the refrigerator 1.

Alternatively, the AI speaker A may transmit the image photographed by the camera A40 to the server 800.

The AI speaker A may transmit the image photographed by the camera A40 or the information about the recognized object in real time to the refrigerator 1 or the server 800. Also, the AI speaker A may transmit the image or the information to the refrigerator 1 or the server 800 in the case in which a preset object is recognized from the image or in the case in which a preset condition is satisfied.

For example, in the case in which situation information is determined based on an image photographed by the camera A40 and a preset condition is satisfied according to the situation information representing that an object enters or is released from the refrigerator 1, the AI speaker A may transmit the photographed image or information about a recognized object to the refrigerator 1 or the server 800. The AI speaker A may determine situation information by further using a voice input to the microphone A20.

As a detailed example, in the case in which the camera A40 photographs an image in which a user carries a kimchi container and moves in a direction toward the refrigerator 1, it may be determined that situation information determined through the corresponding image represents a situation in which the user puts an object into the refrigerator 1. Also, in the case in which a voice input to the microphone A20 includes an intention of needing to put kimchi into the refrigerator 1 or a command of putting kimchi into the refrigerator 1, it may be determined that situation information represents a situation of putting an object into the refrigerator 1.

The controller 200 of the refrigerator 1 may determine a storage room corresponding to the information about the recognized object received from the AI speaker A, and transmit a control signal to the door driver 300 to open the door 40 of the corresponding storage room.

At this time, the controller 200 may control opening time of the door 40 based on a distance between the AI speaker A and the refrigerator 1. For example, the controller 200 may estimate time of arrival at which a user arrives at the refrigerator 1 based on a distance between the AI speaker A and the refrigerator 1 and the user's moving speed, and open the door 40 at the estimated time of arrival. The user's moving speed may be determined based on a normal person's walking speed, or may be the user's average walking speed determined based on images photographed by the AI speaker A, the refrigerator 1, or another appliance with a camera.

In the case in which the refrigerator 1 receives an image from the AI speaker A, the controller 200 may recognize an object from the received image, as described above.

Meanwhile, in the case in which the AI speaker A is managed by the server 800 managing the refrigerator 1, an image photographed by the AI speaker A may be transmitted to the server 800 and the server 800 may perform operations, such as object recognition, a determination of a storage room, etc.

Referring to FIG. 21, in the case in which other refrigerators 2 and 3 are further provided in home, the refrigerator 1 may communicate with the other refrigerators 2 and 3 through the communicator 700. The other refrigerators 2 and 3 may be refrigerators that perform the same functions as those of the refrigerator 1, or specialized refrigerators, such as a kimchi refrigerator, a wine refrigerator, and a freezer, for certain functions.

The refrigerator 1 and the other refrigerators 2 and 3 may communicate with each other directly or through the server 800 that manages the refrigerator 1 and the other refrigerators 2 and 3 together. In the case in which the refrigerator 1 and the other refrigerators 2 and 3 communicate with each other directly, the refrigerator 1 may function as a hub appliance, and the other refrigerators 2 and 3 may transmit/receive data to/from each other through the refrigerator 1.

As described above, the controller 200 may determine whether the storage room corresponding to the recognized object is capable of accommodating the corresponding object, and, according to a result of a determination that the storage room is incapable of accommodating the corresponding object, the controller 200 may output information for guiding the user to the other refrigerators 2 and 3 capable of accommodating the corresponding object, through the speaker 510 or the display 520.

The controller 200 may determine a storage room corresponding to the object from among a plurality of storage rooms provided in the other refrigerators 2 and 3, and transmit a signal for opening a door of the determined storage room to the other refrigerators 2 and 3 through the communicator 700. At this time, the controller 200 may control opening time at which a door of the other refrigerators 2 and 3 opens based on a distance between the refrigerator 1 and the other refrigerators 2 and 3. Operation of controlling the opening time at which the door of the other refrigerators 2 and 3 opens may be performed by the refrigerator 1 or the other refrigerators 2 and 3 of which the door opens.

Alternatively, the controller 200 may transmit the information about the recognized object to the other refrigerators 2 and 3 through the communicator 700, and each of the other refrigerators 2 and 3 may determine whether to be capable of receiving the recognized object.

Meanwhile, in the case in which the object recognized by the controller 200 of the refrigerator 1 is an object to be released from the refrigerator 1, not an object to enter the refrigerator 1, the controller 200 may determine whether the corresponding object exists in the refrigerator 1 based on an output of the internal sensor 150, receive outputs of internal sensors of the other refrigerators 2 and 3 according to a result of a determination that the corresponding object does not exist in the refrigerator 1, and determine whether the corresponding object exists in the other refrigerators 2 and 3. Alternatively, the controller 200 may transmit a signal requesting a confirmation about whether the corresponding object exists in the other refrigerators 2 and 3 to the other refrigerators 2 and 3, and receive results of confirmations from the other refrigerators 2 and 3.

In the case in which the corresponding object exists in the other refrigerators 2 and 3, the controller 200 may display a guide message notifying that the corresponding object exists in the other refrigerators 2 and 3, on the display 520, and open a door of the other refrigerators 2 and 3 in which the corresponding object exists.

Referring to FIG. 22, the refrigerator 1 may communicate with the server 800 through the communicator 700.

The server 800 may be a server that manages the plurality of refrigerators 1, 2, and 3 used by a plurality of users. Also, the server 800 may manage other appliances, such as a display and an AI speaker, together, as well as the refrigerators 1, 2, and 3.

The server 800 may include a communicator 810 (e.g., a transceiver) for communicating with the refrigerator 1 and a controller 820 (e.g., at least one processor) for processing data received from the refrigerator 1.

The refrigerator 1 may transmit an image of surroundings photographed by the camera 110 to the server 800. The communicator 810 may receive the image of surroundings from the refrigerator 1, and the controller 820 may recognize an object from the received image of surroundings, and determine whether to open the door 40 provided in the refrigerator 1 based on the recognized object. According to a result of a determination that the door 40 needs to open, the controller 820 may control the communicator 810 to transmit a signal for opening the door 40 to the refrigerator 1.

In the case in which the refrigerator 1 includes a plurality of storage rooms and a plurality of doors, the controller 820 may determine a storage room corresponding to the recognized object from among the plurality of storage rooms, and control the communicator 810 to transmit a signal for opening a door of the storage room corresponding to the recognized object.

Operation of recognizing an object from an image of surroundings and determining whether to open the door 40 based on the recognized object may be the same as the above-described operation that is performed by the controller 200 of the refrigerator 1. However, because the server 800 manages a plurality of refrigerators used by a plurality of users, the server 800 may collect and manage big data about use patterns of the refrigerators. Accordingly, the controller 200 may learn data obtained from the plurality of users to generate a deep learning model, and determine the storage room corresponding to the recognized object based on the deep learning model.

Also, the controller 820 may determine storage temperature corresponding to the recognized object based on the deep learning model. Information about the storage room and the storage temperature determined by the controller 820 may be transmitted to the refrigerator 1 through the communicator 810.

The communicator 810 may receive temperature information sensed by the temperature sensor 130 of the refrigerator 1. The temperature information sensed by the temperature sensor 130 may be temperature information of the recognized object. The controller 820 may determine storage temperature corresponding to the recognized object by using the temperature information sensed by the temperature sensor 130.

In the case in which the storage room corresponding to the recognized object does not have enough available space and thus is incapable of accommodating the recognized object, the controller 1 may control the communicator 810 to transmit a signal for opening a door to the other refrigerators 2 and 3 registered by the user of the refrigerator 1.

The controller 820 may determine an available space of the storage room by receiving an output of the internal sensor 150 from the refrigerator 1, or the controller 820 may request the refrigerator 1 to determine whether the storage room has an available space and receive a result of the determination.

Also, the communicator 810 may receive an image photographed by a camera provided in another appliance, such as an AI speaker and a TV, from the other appliance, and the controller 820 may recognize an object from the received image and determine a storage room corresponding to the recognized object. The communicator 810 may transmit a signal for opening a door of the storage room corresponding to the recognized object to the refrigerator 1.

Also, operations of the controller 200, such as a determination of situation information and object recognition, as described above with reference to FIG. 20, may be performed by the controller 820 of the server 800.

The communicator 810 may receive a user's voice input to the microphone 140 of the refrigerator 1, and the controller 820 may perform voice recognition on the user's voice to recognize a name of an object and transmit a signal for opening a door to the refrigerator 1 based on the recognized name of the object.

In addition, the entire or a part of various operations that are performed by the controller 200 of the refrigerator 1 may be performed by the controller 820 of the server 800.

Hereinafter, a method of controlling a refrigerator according to an embodiment of the disclosure will be described. The method of controlling the refrigerator according to an embodiment of the disclosure may be applied to the above-described refrigerator 1, ad in some cases, a part of the method may be performed by the server 800. Accordingly, content described above with reference to FIGS. 1 to 22 may be applied to the method of controlling the refrigerator according to an embodiment of the disclosure, unless otherwise noted.

Figure 23:
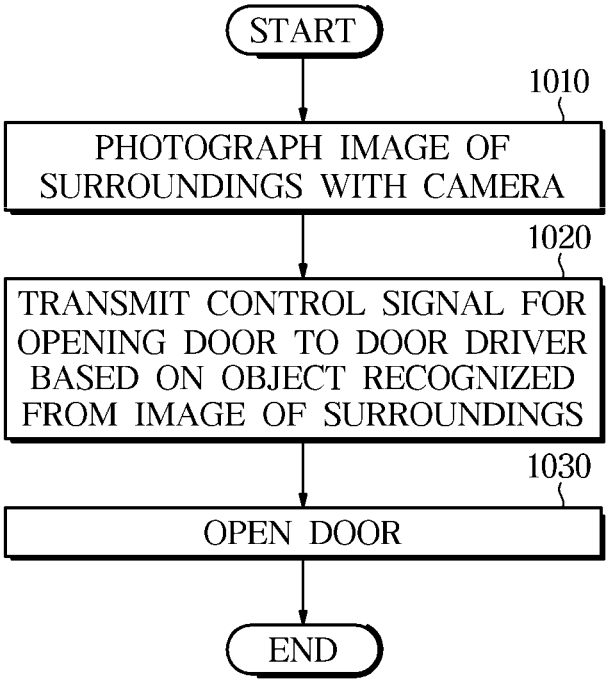
FIGS. 23 to 27 are flowcharts illustrating methods for controlling a refrigerator according to various embodiments of the disclosure.

FIG. 23 is a flowchart illustrating a method of controlling a refrigerator according to an embodiment of the disclosure.

Referring to FIG. 23, the method of controlling the refrigerator according to an embodiment of the disclosure may photograph an image of surroundings with the camera 110, in operation 1010, and transmit a control signal for opening at least one door 40 to the door driver 300 based on an object recognized from the image of surroundings, in operation 1020. In response to the control signal, the door driver 300 may generate power and transfer the power to the at least one door 40 to thereby open the at least one door 40, in operation 1030.

Upon opening of the door 40, a notification sound may be output from the speaker 510 provided in the refrigerator 1, and the controller 200 may determine a user's relative location with respect to the door 40 expected to open, and control the speaker 510 to output a notification sound differently according to the user's relative location. Details about the output of the notification sound have been described above with reference to FIGS. 10 and 11.

Also, the controller 200 may control an opening angle of the door 40 based on the user's relative location with respect to the door 40 expected to open. Details about the control of the opening angle of the door 40 have been described above with reference to FIG. 12.

Operation of recognizing an object from the image of surroundings, photographed by the camera 110, may be performed by the controller 200 of the refrigerator 1 or by the controller 820 of the server 800.

The object recognized from the image of surroundings may be a preset object capable of being kept in the refrigerator 1. Objects capable of being kept in the refrigerator 1 may have been set in advance and then a preset object may be recognized from an image of surroundings, or an object may be recognized from an image of surroundings regardless of a kind of the object and then whether the recognized object is a preset object may be determined.

According to recognition of a preset object, the controller 200 may determine a storage room corresponding to the recognized object from among the plurality of storage rooms 30, 31, 32, and 33, and transmit a control signal for opening a door of the storage room corresponding to the recognized object to the door driver 300.

Figure 24:
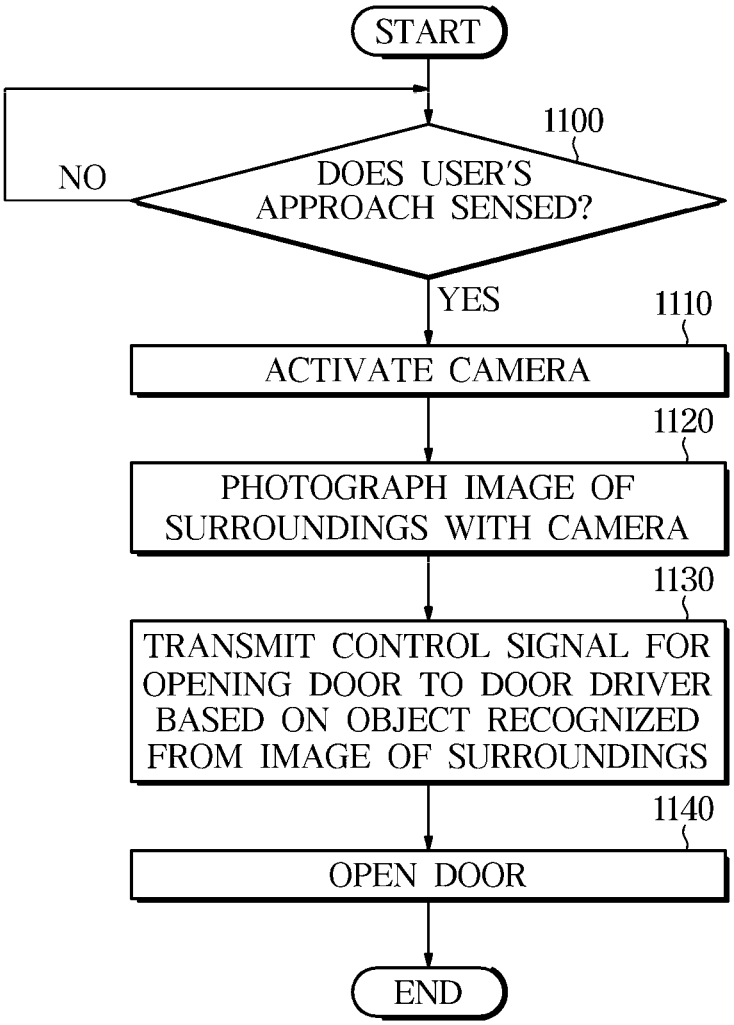

FIG. 24 is another flowchart illustrating a method of controlling a refrigerator according to an embodiment of the disclosure.

Referring to FIG. 24, the method of controlling the refrigerator according to an embodiment of the disclosure may activate the camera 110 in response to a user's approach (YES in operation 1100) sensed by the proximity sensor 120, in operation 1110. In response to an output of the proximity sensor 120 representing a user's approach, the controller 200 may activate the camera 110. According to a specification of the proximity sensor 120, an output of the proximity sensor 120 may itself represent a user's approach or non-approach, or the controller 200 may determine a user's approach based on an output of the proximity sensor 120.

Activation and deactivation of the camera 110 may be implemented softwarily or hardwarily, and details about activation and deactivation of the camera 110 have been described above.

In response to activation of the camera 110, the controller 200 may photograph an image of surroundings with the camera 110, in operation 1120, and transmit a control signal for opening at least one door 40 to the door driver 300 based on an object recognized from the image of surroundings, in operation 1130. In response to the control signal, the door driver 300 may generate power and transfer the power to the at least one door 40 to thereby open the at least one door 40, in operation 1140.

Figure 25:
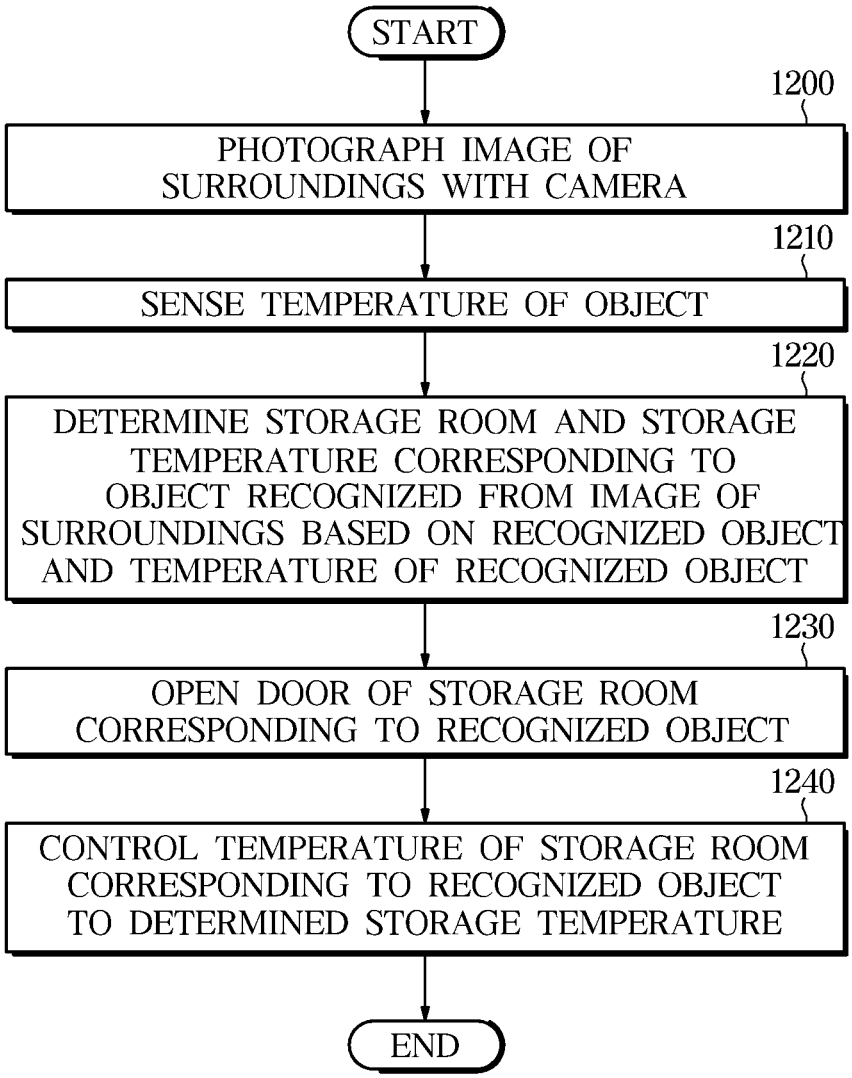

FIG. 25 is another flowchart illustrating a method of controlling a refrigerator according to an embodiment of the disclosure.

Referring to FIG. 25, the method of controlling the refrigerator according to an embodiment of the disclosure may photograph an image of surroundings with the camera 110, in operation 1200, and sense temperature of an object, in operation 1210. The temperature of the object may be sensed by the temperature sensor 130 that senses temperature of an object located around at least one door. For example, the temperature sensor 130 may be a thermal imaging camera.

The controller 200 may determine a storage room and storage temperature corresponding to an object recognized from the image of surroundings based on the recognized object and temperature of the recognized object, in operation 1220. In the case in which the temperature sensor 130 is a thermal imaging camera, the controller 200 may determine temperature of a recognized object based on an image photographed by the thermal imaging camera.

The controller 200 may open a door of a storage room corresponding to the recognized object, in operation 1230, and control temperature of the storage room corresponding to the recognized object to preset storage temperature, in operation 1240. To open the door of the storage room, the controller 200 may transmit a control signal to the door driver 300 for transferring power to the corresponding door, and to control the temperature of the storage room to the preset storage temperature, the controller 200 may transmit a control signal to the cooler 400 for supplying cool air to the corresponding storage room.

Figure 26:
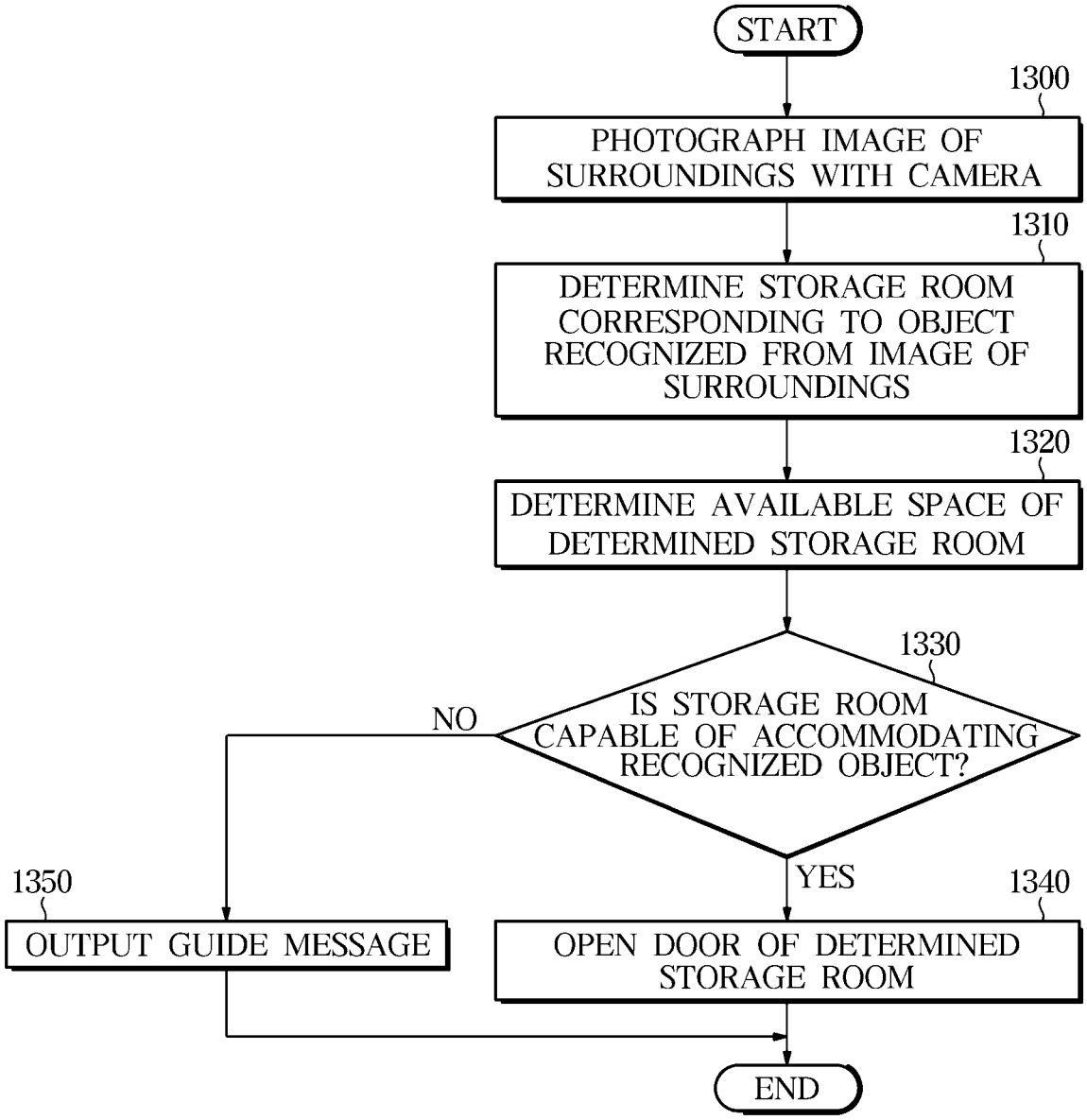

FIG. 26 is another flowchart illustrating a control method according to an embodiment of the disclosure.

Referring to FIG. 26, the control method according to an embodiment of the disclosure may photograph an image of surroundings with the camera 110 in operation 1300, determine a storage room corresponding to an object recognized from the image of surroundings in operation 1310, determine an available space of the storage room in operation 1320, and determine whether the storage room is capable of accommodating the recognized object based on the available space in operation 1330.

To determine the available space of the storage room, the controller 200 may use an output of the internal sensor 150 provided in the refrigerator 1. For example, the internal sensor 150 may include at least one of a weight sensor that senses a weight of an object kept on a shelf provided in at least one of the plurality of storage rooms 30, 31, 32, 33, 35, and 36, a distance sensor that senses an empty space of at least one of the plurality of storage rooms 30, 31, 32, 33, 35, and 36, or an internal camera that obtains an inside image of the refrigerator 1.

More particularly, the controller 200 may calculate a size of the object recognized from the image of surroundings, and calculate an available space of the storage room corresponding to the recognized object based on the output of the internal sensor 150. The controller 200 may compare the size of the recognized object with the available space of the storage room corresponding to the recognized object to determine whether the storage room is capable of accommodating the recognized object.

According to a result of a determination that the storage room is capable of accommodating the recognized object (YES in operation 1330), the controller 200 may open the door of the storage room in operation 1340, and according to a result of a determination that the storage room is incapable of accommodating the recognized object (NO in operation 1330), the controller 200 may output a guide message in operation 1350.

The guide message may be output aurally through the speaker 510 or visually through the display 520. The guide message may include information indicating that the storage room corresponding to the recognized object does not have enough available space, and suggest, in the case in which there is another refrigerator in the user's home, the user to keep the recognized object in the other refrigerator.

Figure 27:
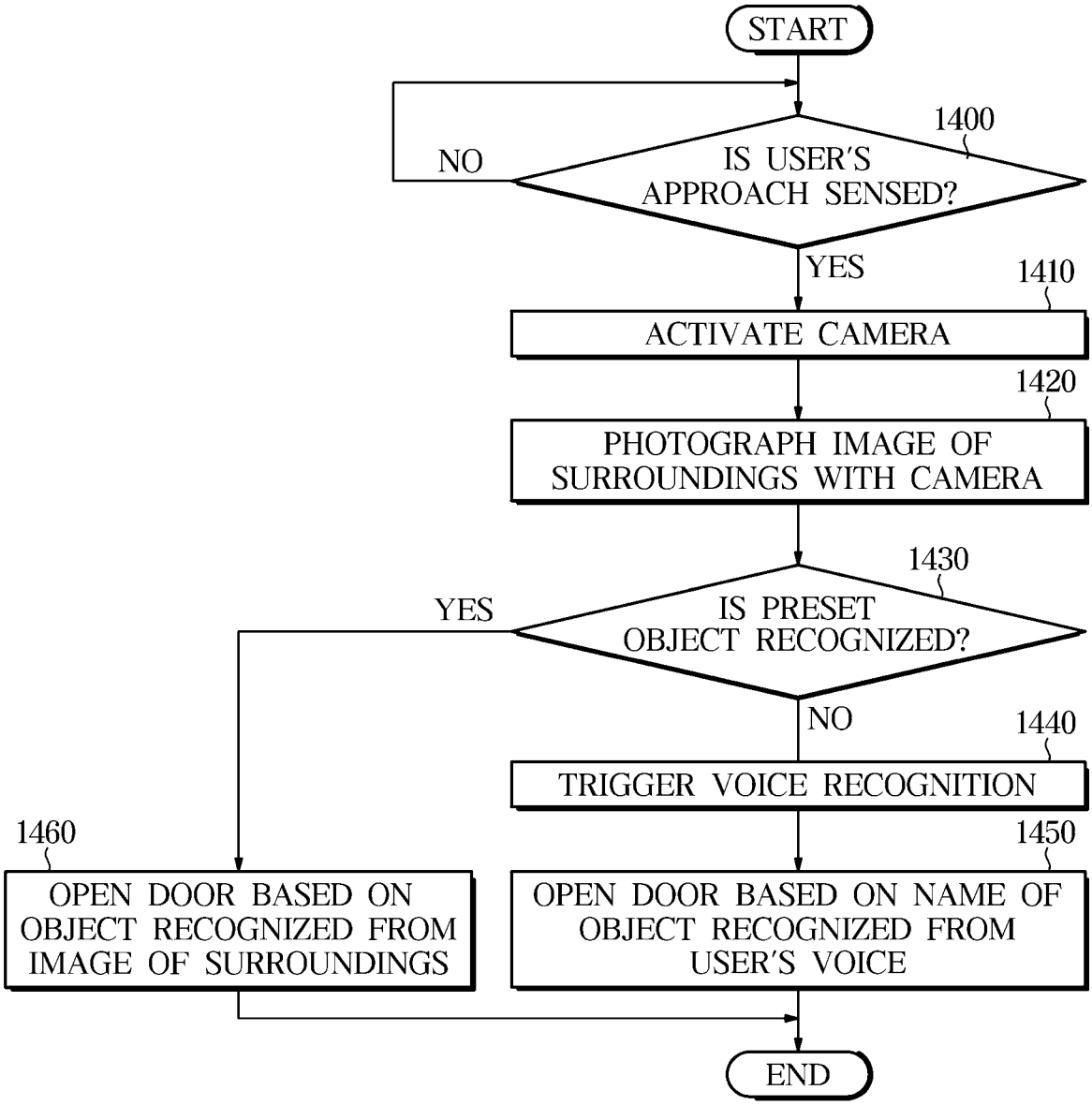

FIG. 27 is another flowchart illustrating a method of controlling a refrigerator according to an embodiment of the disclosure.

Referring to FIG. 27, the method of controlling the refrigerator according to an embodiment of the disclosure may activate, in response to sensing of a user's approach (YES in operation 1400), the camera 110 in operation 1410, photograph an image of surroundings with the camera 110 according to the activation of the camera 110 in operation 1420, and trigger, in the case in which no preset object is recognized from the image of surroundings (NO in operation 1430), voice recognition in operation 1440. In case the preset object is not recognized in operation 1430, the door is opened based on the object recognized from the image of the surroundings in operation 1460.

In the case in which the microphone 140 provided in the refrigerator 1 is in a turned-on state, voice recognition may trigger, and in the case in which the microphone 140 is in a turned-off state, the microphone 140 may be turned on and then voice recognition may trigger. That is, in the case in which an output of the proximity sensor 120 represents a user's approach and no preset object is recognized from an image of surroundings, voice recognition may trigger although a wake-up word or trigger word for voice recognition is not uttered.

The controller 200 may open a door based on a name of an object recognized from a user's voice input to the microphone 140, in operation 1450. More particularly, the controller 200 may open a door of a storage room storing or expected to store an object having a name recognized from a user's voice. The storage room storing the object may be determined based on an output of the internal sensor 150. Also, a storage room which is suitable to store the corresponding object or in which the corresponding object is mainly kept may be estimated as a storage storing the object. Information about the storage room which is suitable to store the corresponding object or in which the corresponding object is mainly kept may have been stored in advance in the controller 200, or may be obtained from the server 800.

The name of the object recognized from the user's voice may be a name of an object which the user intends to take out of the refrigerator 1, or a name of an object which the user intends to keep in the refrigerator 1. For example, in the case in which the controller 200 recognizes that a user carries an object from an image of surroundings, but fails to recognize what the corresponding object is, the controller 200 may determine a name of an object, uttered by the user, as a name of the corresponding object. Accordingly, the controller 200 may determine a storage room corresponding to the object having the name uttered by the user, that is, a storage room that is suitable to store the object having the name uttered by the user, and transmit a control signal for opening the door 40 of the determined storage room to the door driver 300.

The controller 200 may match a shape, size, color, etc. of the object recognized from the image of surroundings with the name of the object, uttered by the user, and store a result of the matching. In the case in which the controller 200 is capable of performing deep learning, features of an object recognized from an image of surroundings, and a name of the object, uttered by a user, may be used as learning data. Thereafter, in the case in which an image of surroundings includes an object having the same feature, the controller 200 may recognize what the corresponding object is.

In the refrigerator, the server, and the refrigerator control method according to an aspect of the disclosure, an object to be stored may be recognized and the door may be automatically opened based on the recognized object.

While the disclosure has been shown and described with reference to various embodiments thereof, it will be understood by those skilled in the art that various changes in form and detail may be made therein without departing from the spirit and scope of the disclosure as defined by the appended claims and their equivalents.

What is claimed is:

1. A refrigerator comprising:

a main body;

at least two doors provided on a front surface of the main body;

a plurality of storage rooms provided in the main body or the at least two doors and configured to store objects;

a cooler configured to cool the plurality of storage rooms;

a door driver configured to generate power for automatically opening or closing each door of the at least two doors;

a camera configured to photograph an image of surroundings around the at least two doors; and at least one processor configured to, in case an object is recognized from the image of the surroundings photographed by the camera, transmit a control signal for opening one of the at least two doors to the door driver based on the recognized object, wherein the at least one processor is further configured to:

determine a door corresponding to the recognized object among the at least two doors, and transmit the control signal for opening the door corresponding to the recognized object to the door driver.

2. The refrigerator of claim 1, wherein the at least one processor is further configured to:

determine a storage room corresponding to the recognized object from among the plurality of storage rooms, and transmit a control signal for opening a door of the storage room corresponding to the recognized object among the at least two doors to the door driver.

3. The refrigerator of claim 2, further comprising:

a temperature sensor configured to sense temperature of an object located around the at least two doors, wherein the at least one processor is further configured to determine, based on temperature sensed by the temperature sensor and the object recognized from the image of surroundings, the storage room among the plurality of storage rooms and storage temperature corresponding to the recognized object.

4. The refrigerator of claim 3, wherein the at least one processor is further configured to transmit a control signal to the cooler to control temperature of the storage room corresponding to the recognized object to the storage temperature.

5. The refrigerator of claim 2, further comprising:

an internal sensor including at least one of a weight sensor, a distance sensor, or an internal camera, the internal sensor provided in the storage room among the plurality of storage rooms; and at least one of a speaker or a display, wherein the at least one processor is further configured to:

determine whether the storage room corresponding to the recognized object is capable of accommodating the recognized object based on an output of the internal sensor, and control, according to a result of a determination that the storage room corresponding to the recognized object is incapable of accommodating the recognized object, the at least one of the speaker or the display to output a guide message related to the result of the determination.

6. The refrigerator of claim 5, further comprising:

a transceiver configured to communicate with another refrigerator, wherein the at least one processor is further configured to control the transceiver to transmit, according to a result of a determination that the storage room corresponding to the recognized object is incapable of accommodating the recognized object, information about the recognized object or a signal for opening a door to the other refrigerator.

7. The refrigerator of claim 2, further comprising:

a drawer configured to slide to be taken out of or put into at least one storage room of the plurality of storage rooms; and a drawer driver configured to at least one of:

generate power for automatically putting the drawer into the at least one storage room, or automatically take the drawer out of at least one storage room among the plurality of storage rooms, wherein the at least one processor is further configured to transmit, in case the drawer is provided in the storage room corresponding to the recognized object, a control signal for taking the drawer out of the storage room to the drawer driver.

8. The refrigerator of claim 1, further comprising:

a proximity sensor configured to sense a user's approach, wherein the at least one processor is further configured to activate the camera, in response to an output of the proximity sensor representing the user's approach.

9. The refrigerator of claim 1, further comprising:

a speaker, wherein the at least one processor is further configured to:

control the speaker to output a notification sound upon automatic opening of the at least two doors, determine a user's relative location with respect to the door expected to open among the at least two doors, and control the speaker to output the notification sound differently according to the user's relative location.

10. The refrigerator of claim 1, wherein the at least one processor is further configured to:

determine a user's relative location with respect to the door expected to open among the at least two doors, and control at least one of an opening angle or an opening speed of the door based on the user's relative location.

11. The refrigerator of claim 1, further comprising:

a microphone, wherein the at least one processor is further configured to transmit, in response to recognizing a name of the recognized object from a user's voice input to the microphone, the control signal for opening the door of the at least two doors to the door driver based on the recognized name of the recognized object.

12. The refrigerator of claim 1, further comprising:

a display provided in one of the at least two doors, wherein the at least one processor is further configured to control, when the recognized object enters at least one of the plurality of storage rooms or is released from at least one of the plurality of storage rooms, the display to display information related to an entrance or a release of the recognized object.

13. The refrigerator of claim 1, further comprising:

a transceiver configured to communicate with an external device, wherein the transceiver is further configured to:

transmit the image of surroundings photographed by the camera to a server, and receive, when the server recognizes the recognized object, information about the recognized object or information about a door corresponding to the recognized object from the server.

14. The refrigerator of claim 13, wherein the transceiver is further configured to receive, from an appliance having a camera, an image photographed by the camera or information about the recognized object recognized from the image photographed by the camera, and wherein the at least one processor is further configured to determine opening time of the door of the at least two doors based on a distance between the appliance and the refrigerator.

15. A method of controlling a refrigerator including a camera, a plurality of storage rooms, and at least two doors positioned on a front surface of the plurality of storage rooms, the method comprising:

photographing an image of surroundings around the at least two doors with the camera;

recognizing an object in the image of the surroundings;

determining a door corresponding to the recognized object among the at least two doors; and opening, in response to the recognition of the object from the image of the surroundings, the door of the at least two doors based on the recognized object.

16. The method of claim 15, wherein the opening of the door of the at least two doors comprises:

determining a storage room corresponding to the recognized object among the plurality of storage rooms; and opening a door of the storage room corresponding to the recognized object among the at least two doors.

17. The method of claim 16, further comprising:

sensing a temperature of the recognized object located around the at least two doors, wherein the opening of the door of the at least two doors comprises determining, based on the sensed temperature and the object recognized from the image of the surroundings, a storage room, among the plurality of storage rooms, and a storage temperature corresponding to the recognized object.

18. The method of claim 17, further comprising:

sensing a user's approach; and activating the camera in response to the sensing of the user's approach.

19. The method of claim 15, wherein the opening of the door of the at least two doors comprises:

determining whether the storage room corresponding to the recognized object is capable of accommodating the recognized object; and opening a door of the storage room corresponding to the recognized object according to a result of a determination that the storage room corresponding to the recognized object is capable of accommodating the recognized object.

20. The method of claim 15, further comprising:

detecting a voice command of a user;

when the voice command of the user identifies the recognized object, determining a storage room among the plurality of storage rooms corresponding to the recognized object; and opening a door of the determined storage room.

* * * * *